US009162857B2

(12) United States Patent
Coccaro

(10) Patent No.: US 9,162,857 B2
(45) Date of Patent: Oct. 20, 2015

(54) PNEUMATIC JACK

(71) Applicant: Albert V. Coccaro, Mt. Kisco, NY (US)

(72) Inventor: Albert V. Coccaro, Mt. Kisco, NY (US)

( * ) Notice: Subject to any disclaimer, the term of this patent is extended or adjusted under 35 U.S.C. 154(b) by 321 days.

(21) Appl. No.: 13/744,511

(22) Filed: Jan. 18, 2013

(65) Prior Publication Data

US 2013/0187108 A1 Jul. 25, 2013

Related U.S. Application Data

(63) Continuation-in-part of application No. 13/355,663, filed on Jan. 23, 2012, now abandoned.

(51) Int. Cl.
*B66F 5/04* (2006.01)
*B66F 3/35* (2006.01)

(52) U.S. Cl.
CPC .... *B66F 3/35* (2013.01); *B66F 5/04* (2013.01)

(58) Field of Classification Search
USPC ..... 254/2 B, 8 R, 9 B, 93 R, 93 HP; 14/69.5, 14/71.1, 71.3, 71.7
See application file for complete search history.

(56) References Cited

U.S. PATENT DOCUMENTS 3,379,411 A 4/1968 Vanderjagt
3,521,861 A * 7/1970 Freudenthal et al. ..... 254/93 L
4,762,298 A * 8/1988 Wood ..... 248/179.1
5,471,693 A * 12/1995 Hodges ..... 14/71.3
6,360,393 B1 * 3/2002 Fritz ..... 14/69.5
2007/0120102 A1 5/2007 Kaplenski

FOREIGN PATENT DOCUMENTS

DE 202004009008 U1 9/2004
FR 2272021 A2 12/1975
JP 49064959 U 6/1974
JP H0569077 U 9/1993

OTHER PUBLICATIONS

Zendex Tool Corporation, RakJak: Pneumatic Jacks Designed Tough and Built to Last, Brochure, 2006, Zendex Tool Corporation, Danbury, CT, USA.

* cited by examiner

*Primary Examiner* — Joseph J Hail
*Assistant Examiner* — J Stephen Taylor
(74) *Attorney, Agent, or Firm* — Law Offices of Michael L. Wise, LLC

(57) ABSTRACT

An apparatus comprises a base, a top member, and a bladder. The top member defines a proximal end and a distal end. The proximal end of the top member is pivotally coupled to the base. The bladder, in turn, is disposed between the base and the top member. Arranged in this manner, the apparatus is operative to raise the distal end of the top member away from the base as the bladder is inflated.

15 Claims, 15 Drawing Sheets

MLH
100
102
104
106
114
122
126
132
134
138
142
144
146
150
162
202

Gas
100
102
104
106
114
122
132
142
144
146
170
172
174
192
202

1306
1310
1336
1332
1334
1308
1316
1342
1302
1320
1318
1322
1330
1340
1324
1338
1326
1342
1328
1314
1304
1312

PNEUMATIC JACK

FIELD OF THE INVENTION

The present invention relates generally to apparatus for applying a lifting force to a stationary object, and, more particularly, to pneumatic jacks.

BACKGROUND OF THE INVENTION

Pneumatic jacks are frequently found in automobile repair facilities. Many such jacks utilize air springs (sometimes called "air lift bags," "air struts," or "air bellows") to create a lifting force. An air spring may comprise a reinforced bladder. Inflation of the bladder by compressed air causes the air spring to expand. A jack pad at the top of the pneumatic jack contacts the vehicle and allows the air spring to raise the vehicle. Pneumatic jacks with air springs may have lifting capacities of three tons or more.

While air-spring-based pneumatic jacks have several advantages, many suffer from the inability to be lowered sufficiently to be used to lift vehicles that sit relatively low to the ground (i.e., low profile vehicles). Because of the space occupied by the air spring when collapsed, an air-spring-based pneumatic jack may only have a minimum lifting height (i.e., collapsed height) of five inches or more. An automobile repair facility may therefore be required to use a conventional floor jack when lifting a low profile vehicle, and, in doing so, forego the ease of use, speed, safety, and convenience of an air-spring-based pneumatic jack. Conventional hydraulic floor jacks may be readily acquired with minimum lifting heights of, for example, only three inches.

For the foregoing reasons, there is a need for air-spring-based pneumatic jack designs having minimum lifting heights compatible with low profile vehicles and other low-standing objects. At the same time, these pneumatic jack designs should provide ample lifting capacities and maximum lifting heights, while also being safe, fast, and easy to use.

SUMMARY OF THE INVENTION

Embodiments of the present invention address the above-identified needs by providing pneumatic jack designs operative to lift low profile vehicles and other low-standing objects.

In accordance with an aspect of the invention, an apparatus comprises a base, a top member, and a bladder. The top member defines a proximal end and a distal end. The proximal end of the top member is pivotally coupled to the base. The bladder, in turn, is disposed between the base and the top member. Arranged in this manner, the apparatus is operative to raise the distal end of the top member away from the base as the bladder is inflated.

In accordance with another aspect of the invention, a method for lifting an object comprises receiving a base and pivotally coupling a proximal end of a top member to the base. A bladder is placed between the base and the top member. Once so configured, a distal end of the top member is raised away from the base by inflating the bladder.

One of the above-identified embodiments comprises a base, a top member, a mounting block, a stabilizing member, an air spring, and an air control valve. A proximal end of the top member is pivotally coupled to the base, while a distal end of the top plate is pivotally coupled to the mounting block. At the same time, the stabilizing member is also pivotally coupled to the base and to the mounting block, although at different locations from the top member. The air spring sits between the base and the top member. Inflating the air spring with the air control valve causes the distal end of the top member and the mounting block to rise away from the base. While the mounting block is rising, the top member and the stabilizing member cooperate to maintain the mounting block at a substantially constant orientation relative to the base.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
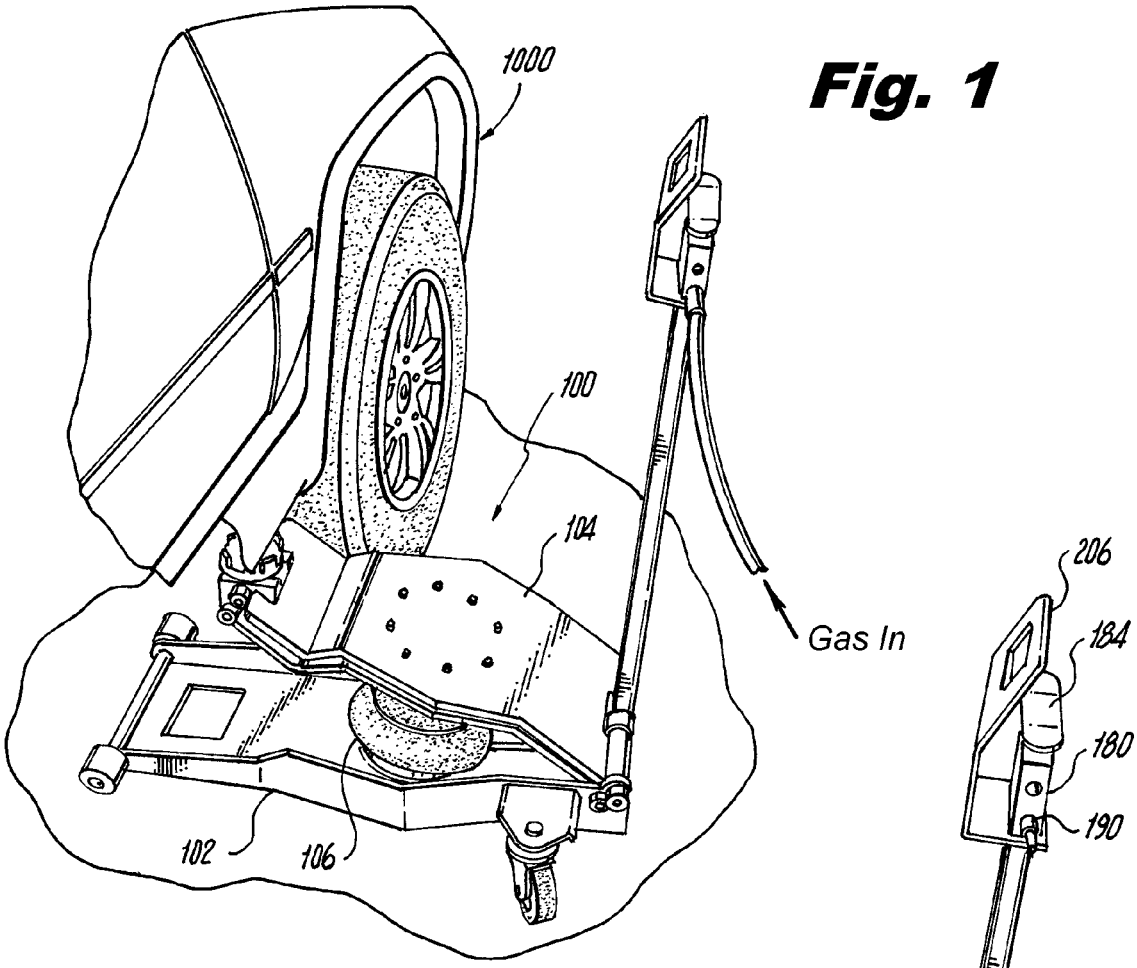
FIG. 1 shows a left perspective view of a pneumatic jack in accordance with a first illustrative embodiment of the invention.

FIG. 1 shows a left perspective view of a pneumatic jack 100 in accordance with a first illustrative embodiment of the invention. In the figure, the pneumatic jack 100 is being used to raise an automobile 1000. Nevertheless, embodiments of the invention may more generally be used to raise vehicles as well as various other types of objects. At its most basic, the illustrative pneumatic jack 100 comprises a base 102, a top member 104, and an air spring 106. The top member 104 defines a proximal end and a distal end. The proximal end of the top member 104 is pivotally coupled to the base 102. The air spring 106, in turn, is disposed between the base 102 and the top member 104. Arranged in this manner, the pneumatic jack 100 is operative to raise the distal end of the top member 104 away from the base 102 as the air spring 106 is inflated. Once so raised, deflation of the air spring 106 allows the distal end of the top member 104 to drop back towards the base 102.

Figure 2:
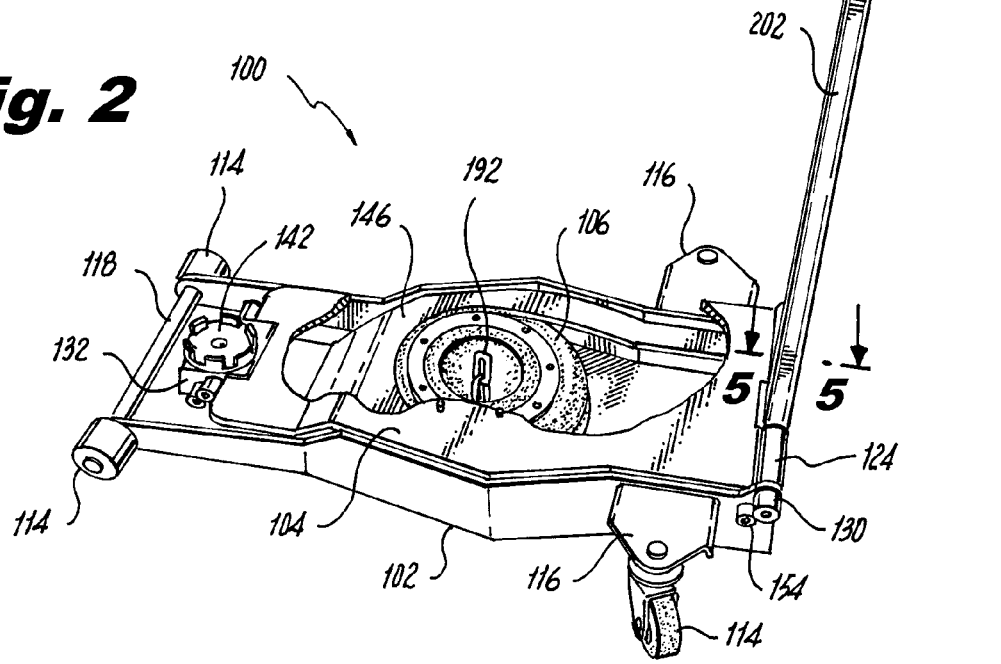
FIG. 2 shows a partially cutaway left perspective view of the FIG. 1 pneumatic jack.
Figure 3:
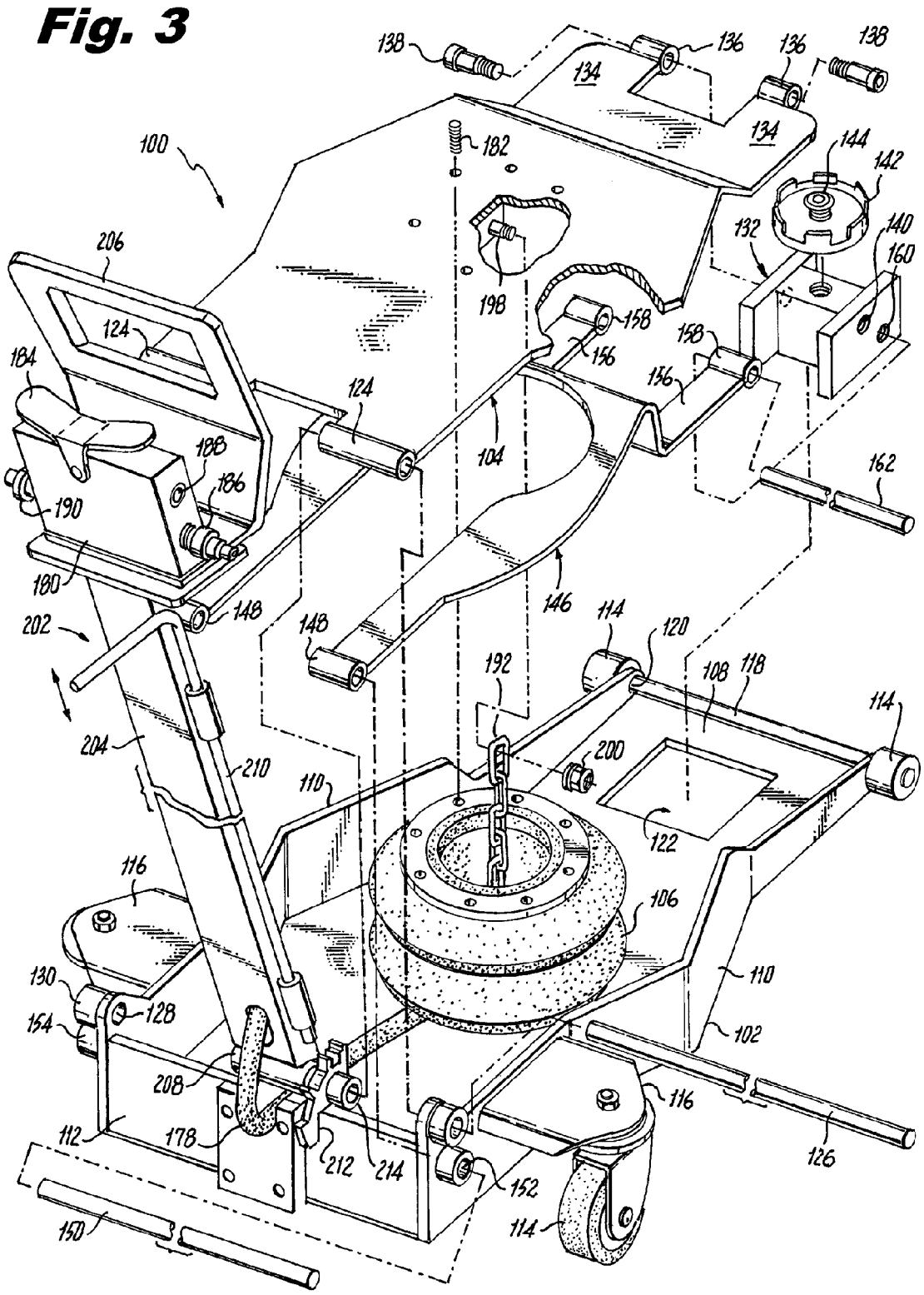
FIG. 3 shows an exploded perspective view of the FIG. 1 pneumatic jack.
Figure 4:
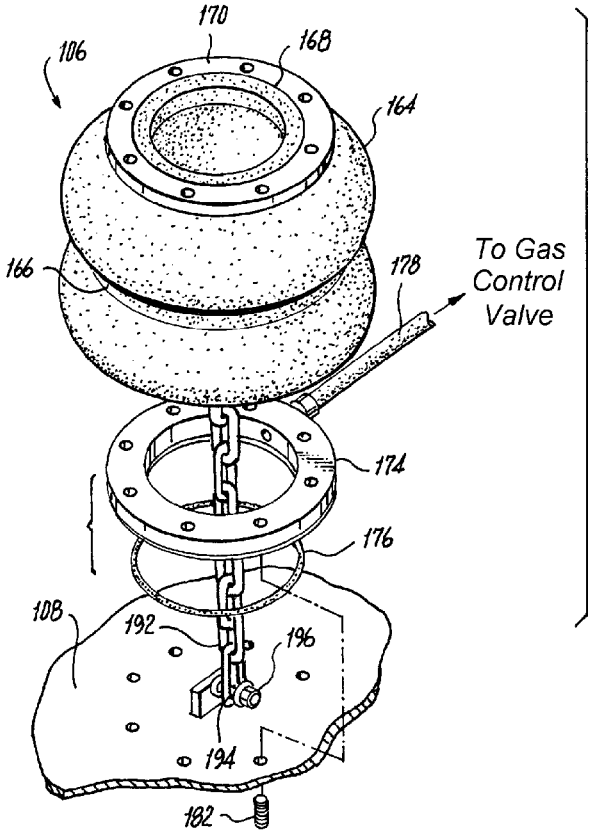
FIG. 4 shows an exploded perspective view of the air spring in the FIG. 1 pneumatic jack.

FIGS. 2-4 go on to show additional details of the illustrative pneumatic jack 100. More particularly, FIG. 2 shows a partially cutaway left perspective view of the pneumatic jack 100; FIG. 3 shows an exploded perspective view of the pneumatic jack 100; and FIG. 4 shows an exploded perspective view of the air spring 106 in the pneumatic jack 100.

In the illustrative pneumatic jack 100, the base 102 comprises a floor plate 108, two opposing sidewalls 110, and a back wall 112. Four wheels 114 are coupled to the base 102. Two castering wheels 114 are affixed under two wheel support plates 116 that project outward from the remainder of the base 102 near the base's proximal end. At the distal end of the base 102, two additional wheels 114 are affixed to a frontal rod 118 that passes through a frontal set of apertures 120 in the two opposing sidewalls 110 of the base 102. The floor plate 108 also defines a window 122, which, as will be described later, facilitates the pneumatic jack 100 in achieving a lower minimum lifting height.

The top member 104 comprises an elongate plate with a downward step about two-thirds along its length. As indicated earlier, the proximal end of the top member 104 is pivotally coupled to the base 102. In the present illustrative embodiment, this pivotal coupling is achieved by having the top member 104 define an upper pair of proximal hollow cylinders 124. Each of the upper pair of proximal hollow cylinders 124 is arranged coaxially with the other and surrounds an upper support rod 126. The upper support rod 126 itself is supported by an upper pair of apertures 128 in the two opposing sidewalls 110 of the base 102 in combination with an upper pair of external cylindrical supports 130. The upper pair of external cylindrical supports 130 are mounted external to the two opposing sidewalls 110, as may be seen in FIGS. 2 and 3.

A mounting block 132 is pivotally coupled to the distal end of the top member 104. Here, the top member 104 defines a pair of top member extensions 134 that are spaced apart from one another. The pair of top member extensions 134 terminate in an upper pair of distal hollow cylinders 136, again arranged coaxially to one another. Two partially threaded bolts 138 pass through the upper pair of distal hollow cylinders 136 and engage threaded holes 140 tapped into opposing sides of the mounting block 132. When screwed into the mounting block 132, the smooth (non-threaded) regions of the two partially threaded bolts 138 fall within the upper pair of distal hollow cylinders 136 and allow the two partially threaded bolts 138, and ultimately the mounting block 132, to pivot freely therein. The mounting block 132 is thereby at least partially disposed between the pair of top member extensions 134 in this manner.

The mounting block 132 is adapted to support a jack pad 142. In this particular embodiment, the jack pad 142 is attached to the mounting block 132 via a single attachment screw 144, although other means of attachment are contemplated and would also fall within the scope of the invention. Use of the single attachment screw 144 allows the jack pad 142 to be rotated relative to the mounting block 132. Moreover, the ability to readily swap jack pads allows different jack pads to be utilized for different applications. The particular exemplary jack pad 142 shown in the figures is well suited for engaging a lift point on a vehicle, but this is merely one example of many possible designs. The jack pad 142 can be easily customized for particular applications (e.g., for engaging a pinch weld on the object being lifted).

In addition to the top member 104, the pneumatic jack 100 further comprises a frame-like stabilizing member 146 that lies below the top member 104. The stabilizing member 146 is pivotally coupled to the base 102 and to the mounting block 132, and has a length along a longitudinal axis of the pneumatic jack 100 similar to that of the top member 104. Moreover, the stabilizing member 146 also has a downward step about two-thirds down its length. Nevertheless, while similar to the top member 104 in these ways, the stabilizing member 146 is distinct from the top member 104, and pivotally couples to the base 102 and to the mounting block 132 at locations different from the top member 104. To pivotally couple to the base 102, the stabilizing member 146 defines a lower pair of proximal hollow cylinders 148, each of which is coaxial with the other and surrounds a lower support rod 150. The lower support rod 150 is positioned slightly lower and slightly forward (i.e., in a direction towards the left in FIG. 2) of the upper support rod 126. In a manner similar to the upper support rod 126, the lower support rod 150 is supported by a lower pair of apertures 152 in the two opposing sidewalls 110 of the base 102, as well as by a lower pair of external cylindrical supports 154.

As can be further seen in FIGS. 2 and 3, the stabilizing member 146 defines an opening through which the air spring 106 passes. At the distal end of the stabilizing member 146, the stabilizing member 146 forms a pair of stabilizing member extensions 156 that are spaced apart from each other. Each of the pair of stabilizing member extensions 156, in turn, defines a respective one of a lower pair of distal hollow cylinders 158. The lower pair of distal hollow cylinders 158 are aligned with a round passage 160 in the mounting block 132. Moreover, the lower pair of distal hollow cylinders 158 and the round passage 160 in the mounting block 132 are positioned slightly lower and slightly forward of where the top member 104 couples to the mounting block 132, mimicking the spatial relationship between the upper and lower support rods 126, 150 at the proximal end of the base 102. A distal rod 162 passes through the lower pair of distal hollow cylinders 158 and the round passage 160 in the mounting block 132 to implement the pivotal coupling between the mounting block 132 and the stabilizing member 146.

The air spring 106 shown in the figures is of a double convoluted type. A bladder 164 defines two interconnected chambers resembling a pair of stacked tires. The bladder 164 may, for example, comprise multiple plies of cord-reinforced rubber. A seam between the two chambers is surrounded by a ring 166, sometimes called a "girdle hoop." In order to form an airtight seal with the top member 104, an uppermost lip 168 of the bladder 164 is pressed against the top member 104 by an upper flange 170. At the opposite end of the bladder 164, a lowermost lip (not visible) is captured between a first lower flange 172 and a second lower flange 174. An elastic O-ring 176 (e.g., rubber O-ring) is placed between the second lower flange 174 and the floor plate 108 of the base 102 to form an airtight seal therebetween. The second lower flange 174 also receives an air hose 178 from a gas control valve 180 that facilitates the inflation and deflation of the bladder 164. Multiple threaded bolts 182 engage threads in the various flanges 170, 172, 174 and allow the flanges 170, 172, 174 to be fixedly attached to the top member 104 and to the base 102, as appropriate.

While the particular air spring 106 shown in the figures is of the double convoluted type, this design choice is merely illustrative. More generally, any form of bladder or bellows capable of being inflated may be utilized in place of the illustrative air spring 106 and the results would still come within the scope of the invention. For example, instead of utilizing a double convoluted air spring, a single convoluted air spring or a triple convoluted air spring could be utilized instead. Moreover, in one or more alternative embodiments of the invention, a rolling lobe air spring or sleeve bag air spring could also be implemented.

Inflation and deflation of the air spring 106 are manually controlled via the gas control valve 180. The gas control valve 180 may be of the type used for pneumatic lifts and hoists. More particularly, the gas control valve 180 is preferably of the "two step" type, allowing a compressed gas to be directed into and out of the air spring 106, as well as allowing the air spring 106 to be isolated so that it remains in a given state (e.g., raised or lowered). In the present embodiment, the gas control valve 180 includes a rocker 184 that allows the user to select between inflation and deflation by pressing on one side of the rocker 184 or the other. In use, a compressed gas such as compressed air is introduced into the gas control valve 180 via an input port 186. A suitable pressure for the compressed gas may be, for example, about 105 pounds per square inch (psi). Gas released during deflation is expelled through an exhaust port 188. To avoid over-pressurizing the air spring 106, a pressure relief safety valve 190 is fitted to the gas control valve 180.

Moreover, in accordance with aspects of the invention, the illustrative pneumatic jack 100 further comprises a chain 192. The chain 192 may be seen, for example, in FIGS. 2-4. The chain 192 resides within the air spring 106. One end of the chain 192 is attached to the floor plate 108 of the base 102 via a lower threaded mounting pin 194 and a lower nut 196, and the other end of the chain 192 is attached to the top member 104 via an upper threaded mounting pin 198 and an upper nut 200. In this manner, the chain 192 spans between the base 102 and the top member 104 and limits an extent to which the pneumatic jack 100 can raise the distal end of the top member 104 away from the base 102. Once the chain 192 is fully extended, the distal end of the top member 104 cannot rise any further. Instead, any additional inflation of the air spring 106 only acts to increase the pressure in the air spring 106. Excessive pressure is relieved by the pressure relief safety valve 190, as necessary, to maintain safety. While a chain is utilized in the present embodiment, alternative embodiments can utilize any form of linking member including, but not limited, to a chain, a cord, a cable, a strap, a belt, or a combination thereof.

In the present embodiment, transport and positioning of the pneumatic jack 100 is further facilitated by a handle 202. The handle 202 comprises an elongate handle portion 204 that terminates at its top in the gas control valve 180 and a grip 206. At the bottom of the elongate handle portion 204, the handle 202 defines a bottom hollow cylinder 208 that surrounds the upper support rod 126 (i.e., the same support rod supporting the top member 104). The handle 202 is thereby pivotally coupled to the base 102 in this manner. A handle adjustment pin 210 runs down the elongate handle portion 204 and impinges on a receiving block 212. The receiving block 212, in turn, defines a receiving block hollow cylinder 214 that also surrounds the upper support rod 126 (best seen in FIG. 3). However, unlike the handle 202, the receiving block 212 is not allowed to rotate relative to the base 102. Instead, the receiving block 212 further defines a receiving block notch 216 that engages the back wall 112 of the base 102. Rotation of the receiving block 212 relative to the base 102 is thereby substantially eliminated.

Figure 5:
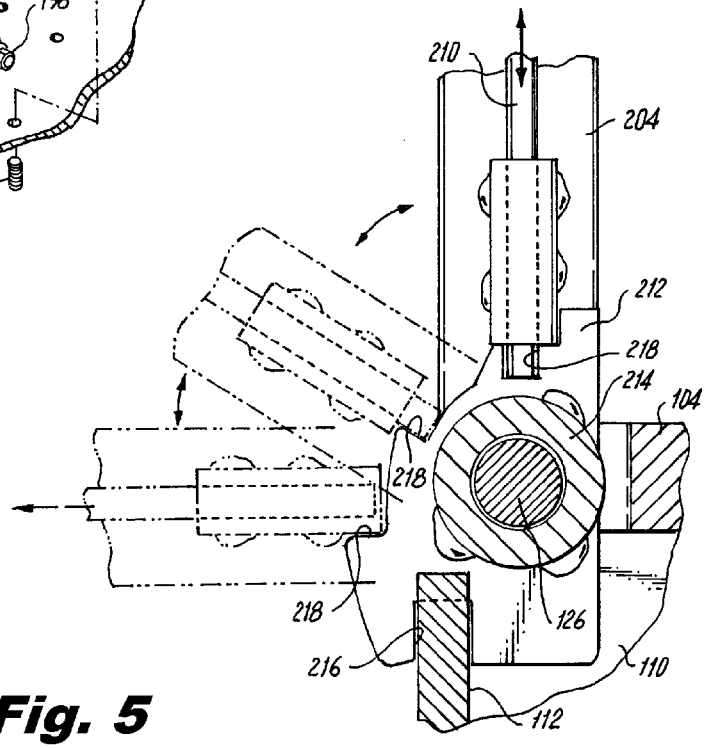
FIG. 5 shows a sectional view of the handle and receiving block in the FIG. 1 pneumatic jack.

FIG. 5 shows a sectional view that highlights aspects of the handle 202 and the receiving block 212. The receiving block 212 and the handle adjustment pin 210 cooperate to provide a locking mechanism for fixing an angle at which the handle 202 couples to the base 102. In the present embodiment, the receiving block 212 defines three handle adjustment notches 218 into which the handle adjustment pin 210 may drop when the handle 202 achieves one of three handle positions: a "raised" position wherein the handle 202 stands substantially upright and about normal to the base 102; a "middle" position wherein the handle 202 is at an oblique angle relative to the base 102; and a "lowered" position wherein the handle 202 lies substantially flat and about parallel with the base 102. With the handle 202 in its raised or middle positions, lowering the handle 202 is inhibited by the handle adjustment pin 210 striking a vertical sidewall of one of the handle adjustment notches 218. A user may manually overcome this locking mechanism by simply lifting up on the handle adjustment pin 210 when lowering the handle angle.

Figure 6:
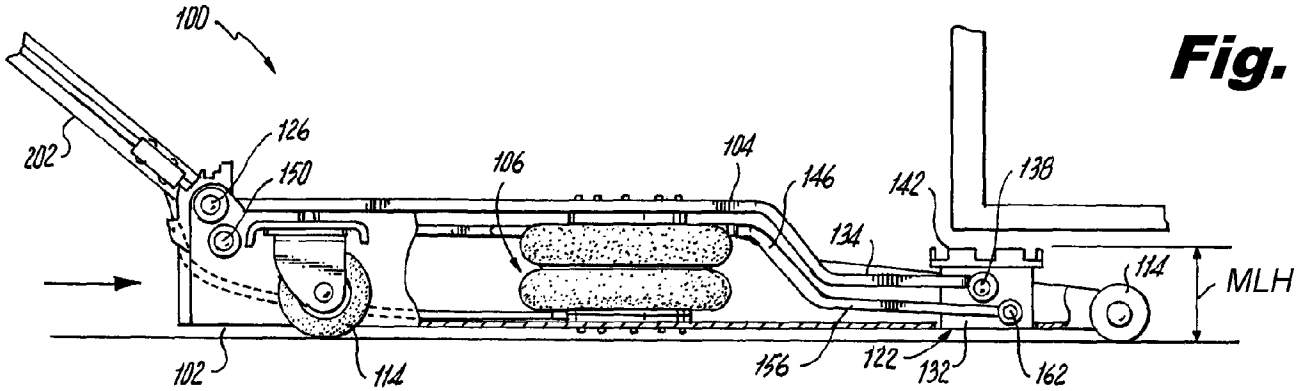
FIG. 6 shows a partially cutaway right elevational view of the FIG. 1 pneumatic jack in its lowered state.
Figure 7:
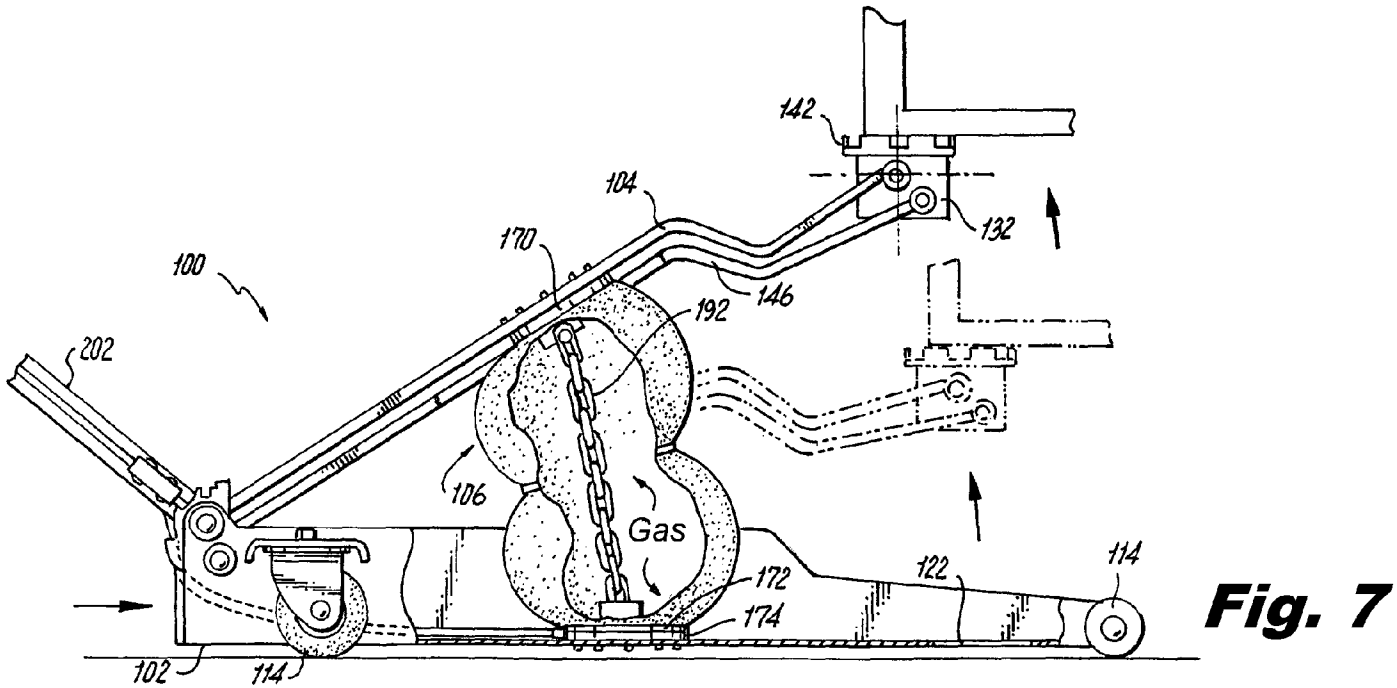
FIG. 7 shows a partially cutaway right elevational view of the FIG. 1 pneumatic jack transitioning from its lowered state to its raised state.

FIGS. 6 and 7 act to reveal additional details of how the pneumatic jack 100 functions when lifting an object. FIG. 6 shows a right elevational view of the pneumatic jack 100 in its lowered state while the pneumatic jack 100 is in place to lift an object. FIG. 7 shows a partially cutaway right elevational view of the pneumatic jack 100 transitioning from its lowered state to its raised state.

In its lowered state, the window 122 in the floor plate 108 of the base 102 allows the mounting block 132 to be dropped even lower to the ground so as to achieve the most favorable minimum lifting height (labeled as "MLH" on FIG. 6). Inflation of the air spring 106, in turn, causes the distal end of the top member 104 to describe an arc when rising away from the base 102. Because such an arc-like path might be unfavorable if it were to induce a tilting (or torqueing) motion in the mounting block 132, any tilting of the mounting block 132 while being raised or lowered is substantially eliminated by the top member 104 and the stabilizing member 146. More particularly, the geometries of the top member 104 and the stabilizing member 146, as well as their various pivotal connections to the base 102 and mounting block 132, cooperate to pivot the mounting block 132 so that it remains at a substantially constant orientation relative to the base 102 while the pneumatic jack 100 raises and lowers the distal end of the top member 104. The mounting block 132 thereby remains substantially level while in use. The raising and lowering of the distal end of the top member 104 is also accompanied by a small translation of the mounting block 132 towards and away from, respectively, the proximal end of the base 102. Nevertheless, this lateral translation is compensated for by simply allowing the entire pneumatic jack 100 to roll forward and backward slightly on its wheels 114 so that the mounting block 132 remains stationary under the object being lifted.

As indicated in the Background, a conventional pneumatic jack, namely one comprising a jack pad that sits directly on top of an air spring, may have a minimum lifting height of five inches or more in large part due to the height occupied by the air spring when it is deflated (i.e., collapsed). At the same time, the stroke of such a conventional pneumatic jack (i.e., the difference in height of the jack pad when the pneumatic jack is fully raised and fully lowered) is limited by the extent by which the air spring increases in height when inflated. A conventional pneumatic jack with a double convoluted air spring, for example, may only have a stroke of about eight inches. A conventional pneumatic jack with a triple convoluted air spring may only have a stroke of about 12 inches.

Aspects of the invention address these shortcomings. In the pneumatic jack 100, for example, the shapes of the top member 104 and the mounting block 132 allow the jack pad 142 to be positioned lower than the height of the top of the air spring 106 (see FIG. 6). Concurrently, the placement of the air spring 106 under the top member 104 relative to the point where the top member 104 pivotally couples to the base 102 (the "hinge point of the top member") allows the pneumatic jack 100 to achieve a stroke greater than the extent by which the air spring 106 increases in height when inflated (see FIG. 7). In fact, the maximum lifting height of a pneumatic jack in accordance with aspects of the invention may be modified by adjusting the position of the air spring relative to the hinge point of the top member and/or by adjusting the length of the top member.

In actual reduction to practice, prototypes in accordance with aspects of the invention demonstrated low minimum lifting heights as well as ample maximum lifting heights and lifting capacities. One such prototype, designed in a manner similar to the illustrative pneumatic jack 100 and having a double convoluted air spring, for example, demonstrated a minimum lifting height of about three inches and a maximum lifting height of about 16 inches, thereby achieving a minimum lifting height similar to that of many floor jacks and a stroke of about 13 inches. Lifting capacity was estimated to be about 2,500 pounds or more. At the same time, the prototype was consistently safe, fast, and easy to use. Lift times (i.e., the time required to raise the prototype from its lowered condition to its raised condition) were estimated to be only a few seconds with about 105 psi input air. The handle and wheels made the prototype very easy to move and position.

Once the novel aspects of the invention are understood from the teachings herein, embodiments of the invention may, to a large extent, be formed utilizing conventional forming and fabrication techniques. Parts such as the base 102, the top member 104, the mounting block 132, the jack pad 142, the stabilizing member 146, the flanges 170, 172, 174, and the rods 118, 126, 150, 162, for example, are preferably (but not necessarily) formed from one or more metals such as steel, aluminum, or brass. These parts may be formed utilizing conventional metal fabrication techniques such as machining, stamping, forging, casting, cutting (manual and/or under computer numerical control (CNC)), bending, and welding. These metalworking techniques and others will be familiar to one having ordinary skill in the fabrication arts. Moreover, metalworking techniques are described in readily available references including, but not limited to, R. A. Walsh et al., *McGraw-Hill* 2006 *Machining and Metalworking Handbook*, McGraw-Hill, 2006, which is hereby incorporated by reference herein. After initial formation, the parts may also optionally be powder coated or plated with a surface coating (e.g., zinc or chrome) to increase durability.

Other elements required to form embodiments of the invention may be sourced from commercial vendors. Suitable rubber bladders may be sourced from, as just one example, Veyance® Technologies, Inc. (Fairlawn, Ohio, USA). Suitable gas control valves (e.g., lift and hoist type valves) and their associated components (e.g., pressure relief safety valves) may be sourced from, as just another example, Storm Manufacturing Group, Inc. (also known as Kingston Valves) (Torrance, Calif., USA).

It should again be emphasized that the above-described embodiments of the invention are intended to be illustrative only. Other embodiments can use different types and arrangements of elements for implementing the described functionality. As just one example, the coupling of one object to another (whether fixedly or pivotally) can be performed in ways different from those explicitly recited herein while still obtaining the same or similar overall functionality. Alternative embodiments may, as just a few examples, utilize attachment means such as screws, bolts, rods, adhesives, brackets, pins, hooks, welds, hinges, chemical bonds, and the like to implement aspects of the invention. These numerous alternative embodiments within the scope of the appended claims will be apparent to one skilled in the mechanical arts.

Figure 8:
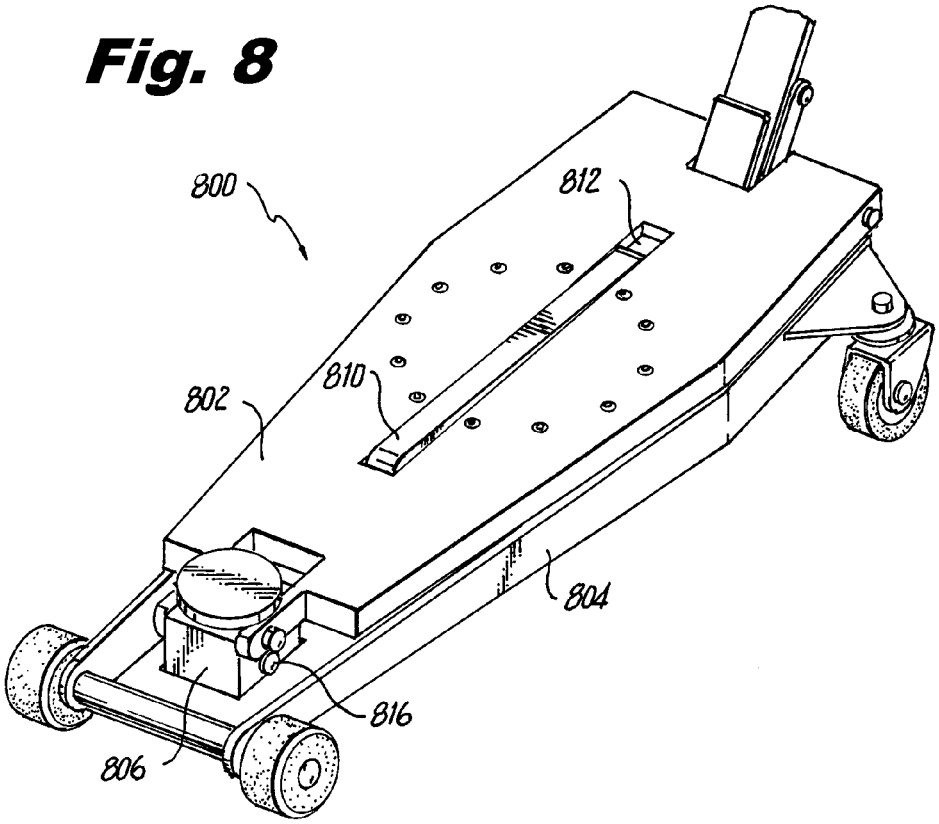
FIG. 8 shows a left perspective view of a pneumatic jack in accordance with a second illustrative embodiment of the invention.
Figure 9:
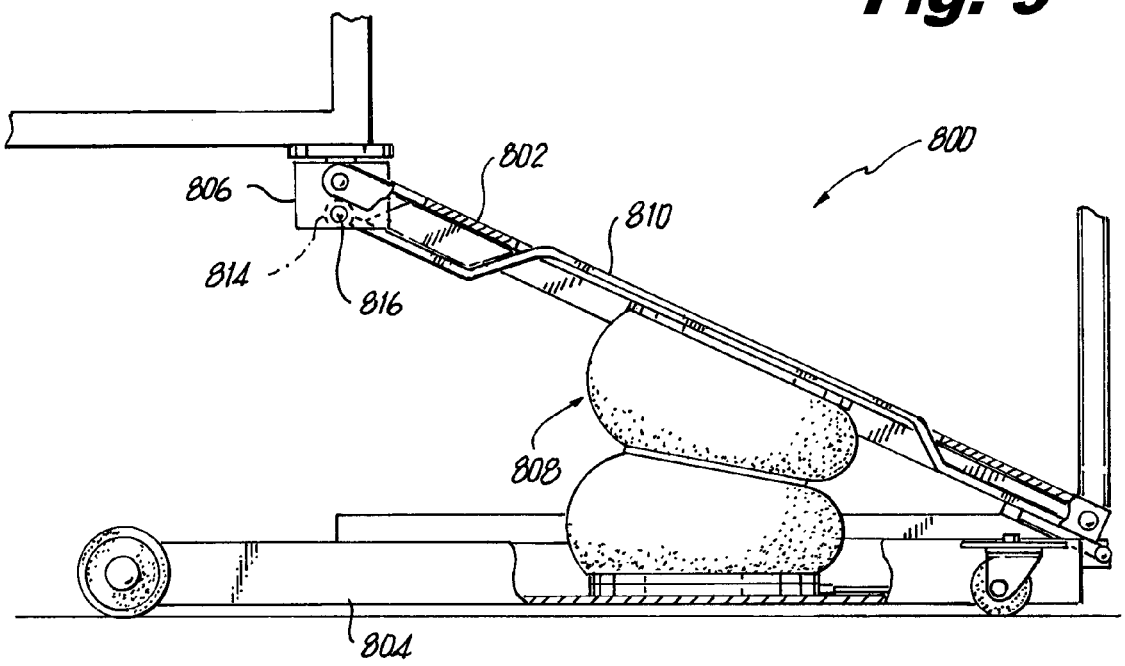
FIG. 9 shows a partially cutaway left elevational view of the FIG. 8 pneumatic jack.

One or more alternative embodiments falling within the scope of the appended claims may also utilize very different forms of stabilizing members. FIGS. 8 and 9 show a pneumatic jack 800 in accordance with a second illustrative embodiment of the invention. FIG. 8 shows a left perspective view of the pneumatic jack 800, while FIG. 9 shows a partially cutaway left elevational view of the pneumatic jack 800.

While appearing somewhat different from the pneumatic jack 100, the pneumatic jack 800 contains many similar elements and therefore functions in an analogous manner. A top member 802 is pivotally mounted at its proximal end to a base 804. At the distal end of the top member 802, the top member 802 is pivotally mounted to a mounting block 806. An air spring 808 (double convoluted type) is disposed between the base 804 and the top member 802. Inflation of the air spring 808 causes the distal end of the top member 802 and the mounting block 806 to rise away from the base 804.

Nevertheless, while a stabilizing member 810 in the pneumatic jack 800 is also pivotally coupled to the base 804 and the mounting block 806 in a manner similar to the stabilizing member 146 in the pneumatic jack 100, the stabilizing member 810 itself has a substantially different shape. In the pneumatic jack 800, the stabilizing member 810 is shaped like a bar and passes over the top of the air spring 808 rather than around the air spring 808. This alternative path for the stabilizing member 810 is facilitated by an opening 812 in the top member 802. To pivotally couple to the mounting block 806, the stabilizing member 810 defines a single hollow cylinder 814 that surrounds a pin 816 that passes through the mounting block 806 and is exposed by a cutout in the bottom of the mounting block 806.

In use, the stabilizing member 810 cooperates with the top member 802 in the pneumatic jack 800 in a manner similar to the way the stabilizing member 146 and the top member 104 cooperate in the pneumatic jack 100. The stabilizing member 810 and the top member 802 act together to maintain the mounting block 806 at a substantially constant orientation relative to the base 804 while the pneumatic jack 800 raises the distal end of the top member 802 away from the base 804.

Figure 10:
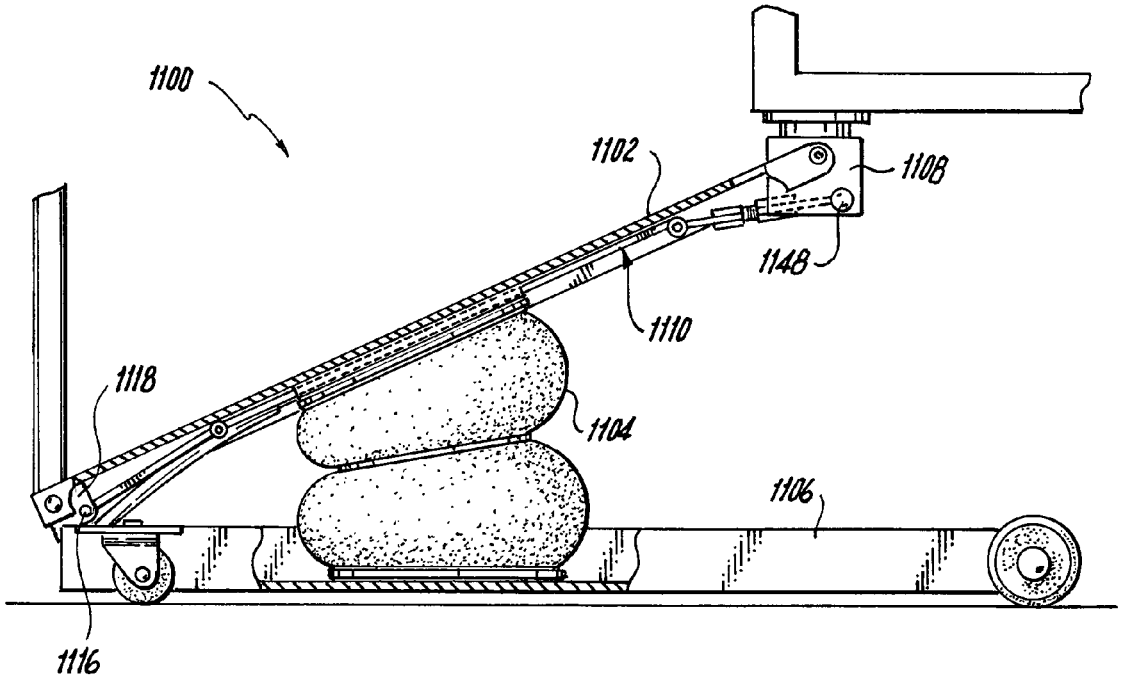
FIG. 10 shows a partially cutaway right elevational view of a pneumatic jack in accordance with a third illustrative embodiment of the invention.
Figure 11:
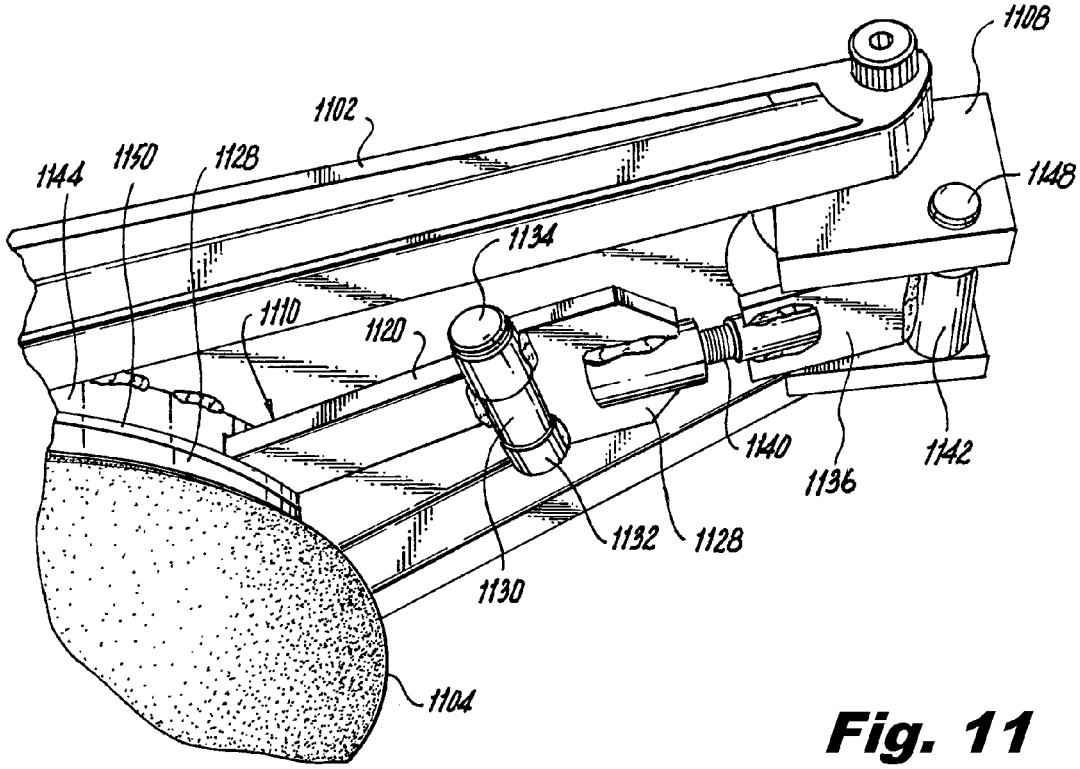
FIG. 11 shows a perspective view of the underside of the top member in the FIG. 10 pneumatic jack.
Figure 12:
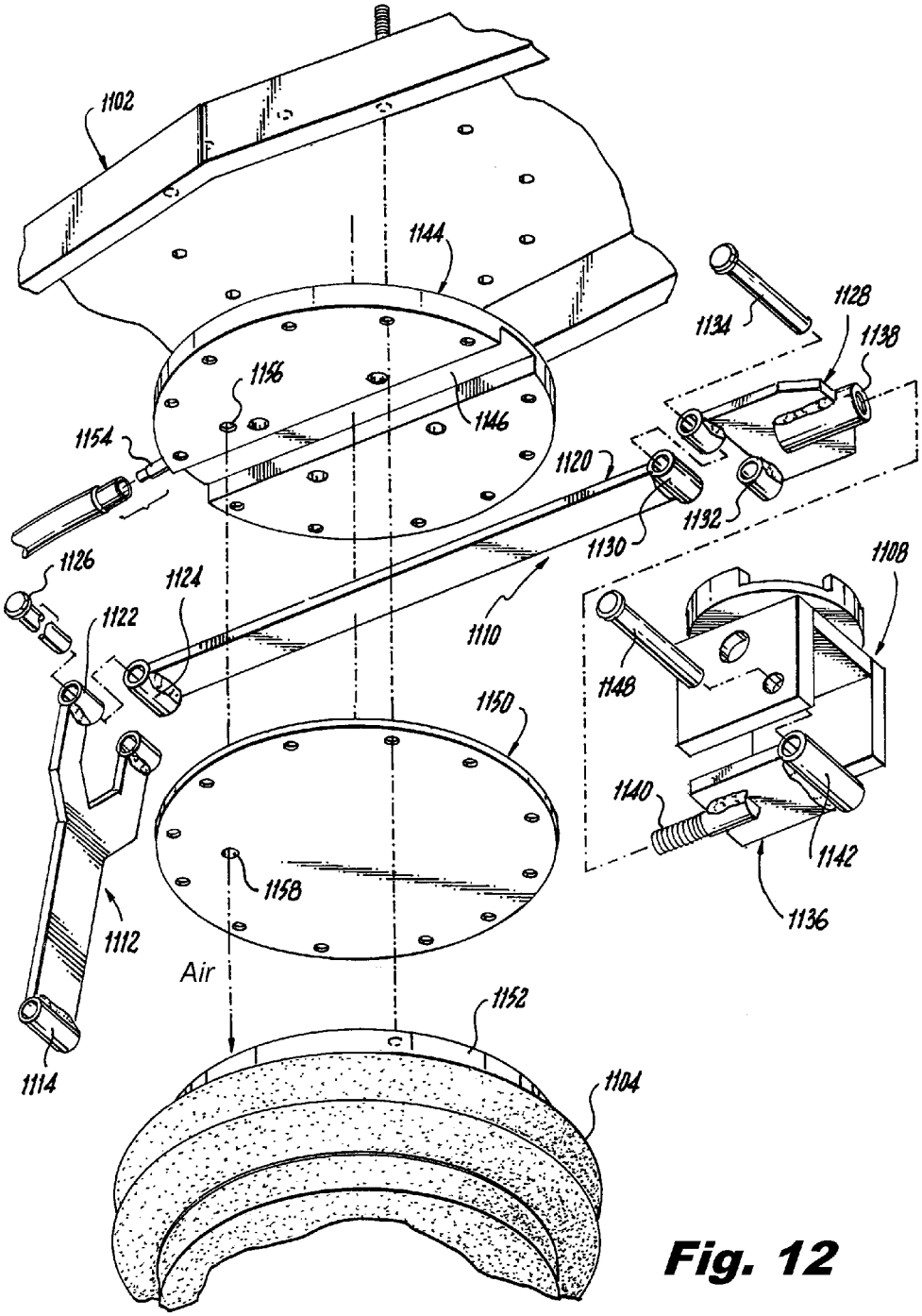
FIG. 12 shows an exploded perspective view of the region proximate to the top of the air spring in the FIG. 10 pneumatic jack.

In even another alternative embodiment falling within the scope of the invention, a stabilizing member is routed between the air spring and the top member without penetrating the top member in the manner of the stabilizing member 810. FIGS. 10-12 show a pneumatic jack 1100 in accordance with a third illustrative embodiment of the invention. FIG. 10 shows a partially cutaway right elevational view of the pneumatic jack 1100; FIG. 11 shows a magnified perspective view of the underside of a top member 1102 of the pneumatic jack 1100; and FIG. 12 shows an exploded perspective view of the region of the pneumatic jack 1100 proximate to the top of an air spring 1104.

The top member 1102 is pivotally mounted at its proximal end to a base 1106. At the distal end of the top member 1102, the top member 1102 is pivotally mounted to a mounting block 1108. The air spring 1104 (again, a double convoluted type in this particular embodiment) is disposed between the base 1106 and the top member 1102. Inflation of the air spring 1104 causes the distal end of the top member 1102 and the mounting block 1108 to rise away from the base 1106.

An alternative stabilizing member 1110 in the pneumatic jack 1100 is also pivotally coupled to the base 1106 and the mounting block 1108, and, in so doing, cooperates with the top member 1102 to maintain the mounting block 1108 at a substantially constant orientation relative to the base 1106 while the pneumatic jack 1100 raises and lowers the top member 1102. As best seen in FIG. 12, the stabilizing member 1110 has four portions. A first portion 1112 of the stabilizing member 1110 is pivotally attached to the base 1106 at a position somewhat forward and below where the top member 1102 attaches to the base 1106. Fixation is via a first hollow cylinder 1114 and a support rod 1116 that passes through a mounting fixture 1118 in the base 1106. A second portion 1120 of the stabilizing member is pivotally affixed to the first portion 1112 utilizing second coaxial hollow cylinders 1122 and 1124 in combination with a second support rod 1126. A third portion 1128 of the stabilizing member 1110 is pivotally attached to the second portion 1120 using third coaxial hollow cylinders 1130 and 1132 in combination with a third support rod 1134. Lastly, a fourth portion 1136 of the stabilizing member 1110 is attached to the third portion 1128 utilizing a threaded female receiver 1138 defined by the third portion 1128 and a male threaded rod 1140 defined by the fourth portion 1136. In a manner similar to that for the stabilizing member 810, in order to pivotally couple to the mounting block 1108, the stabilizing member defines a single hollow cylinder 1142 that surrounds a pin 1148 that passes through the mounting block 1108 and is exposed by a cutout in the bottom of the mounting block 1108.

The second portion 1120 of the stabilizing member 1110 passes through a region between the air spring 1104 and the top member 1102. In the present illustrative embodiment, this path is facilitated by a top mounting plate 1144 that defines a longitudinal slot 1146 therein. A sealing plate 1150 is then inserted between the top mounting plate 1144 and an upper flange 1152 of the air spring 1104. With the top mounting plate 1144 tightly bolted through the sealing plate 1150 into the upper flange 1152, the air spring 1104 is made airtight. In the present embodiment, the top mounting plate 1144 is equipped with a nipple 1154 that allows the air spring 1104 to be inflated and deflated. During inflation, pressurized air received at the nipple 1154 passes through a first opening 1156 in the top mounting plate 1144 and a matching second opening 1158 in the sealing plate 1150 into the air spring 1104. Notably, the ability to inflate from the top of the air spring 1104 rather than from the bottom (as was the case in the pneumatic jack 100) may be preferable in some configurations, including those configurations that utilize a tilting plate for the air spring 1104, which is described next.

When utilizing a pneumatic jack similar to the pneumatic jack 100 described in FIGS. 1-7, it has been observed that lifting force declines somewhat as the air bag inflates. That is, near the top of the lift, the lifting force is less than at the beginning of the lift. This loss of lifting force is believed to be at least partially attributable to the arc described by the air spring during inflation (see, e.g., FIG. 7; arcing of the air spring 106). Accordingly, this loss of lifting force may be mitigated by utilizing alternative pneumatic jack embodiments that include a mechanism that keeps the top of the air spring substantially parallel to the bottom of the air spring during inflation and deflation (i.e., keeps the air spring substantially "linear" during inflation and deflation).

Figure 13:
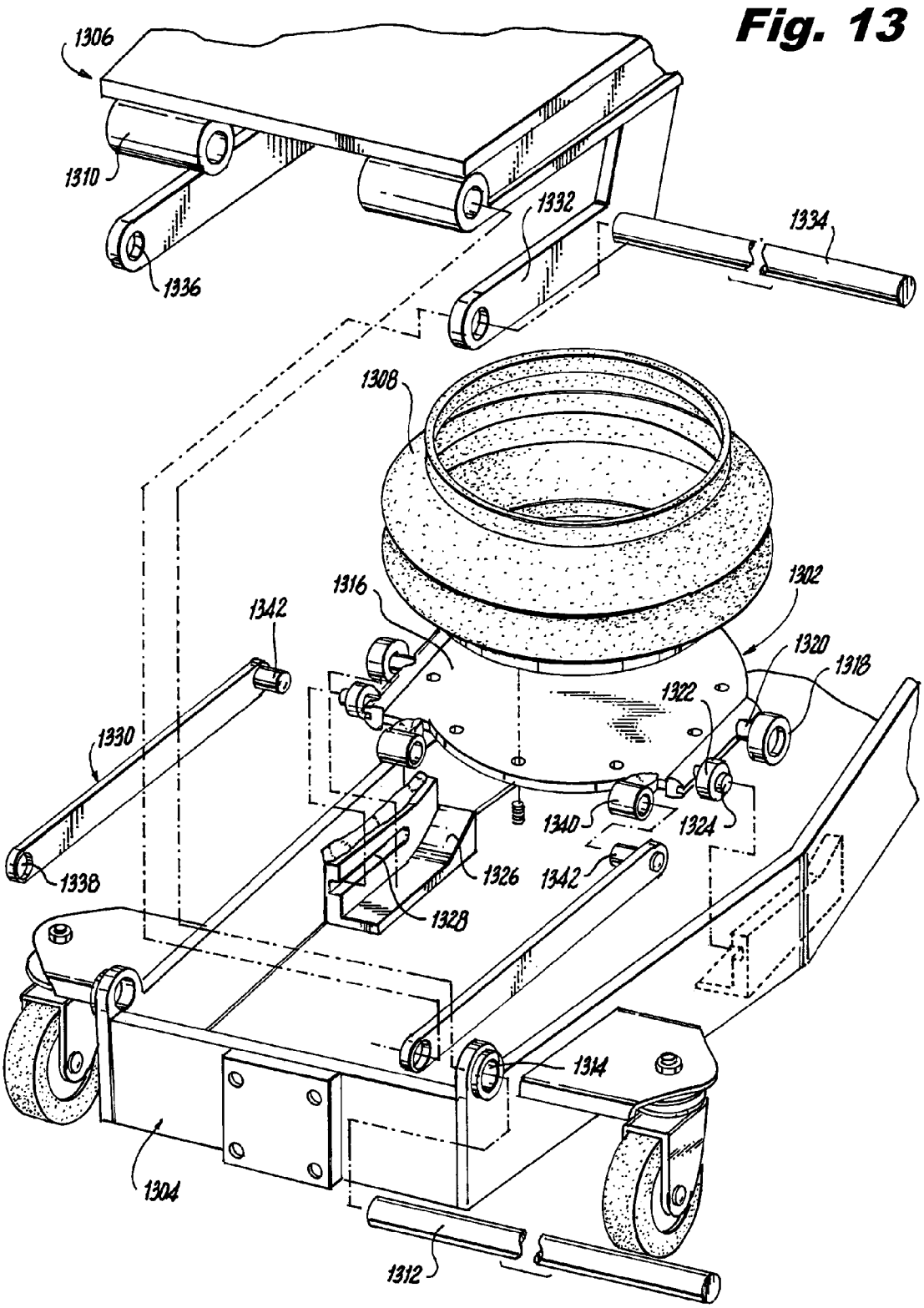
FIG. 13 shows an exploded perspective view of a portion of a pneumatic jack in accordance with a fourth illustrative embodiment of the invention.

FIG. 13 shows an exploded perspective view of a portion of a pneumatic jack 1300 with a tilting plate 1302, in accordance with a fourth illustrative embodiment of the invention. For purposes of ease of description, this figure is purposefully limited to only those features that are deemed most important to describing aspects of the tilting plate 1302 rather than including all the elements already described in detail above. In addition to the tilting plate 1302, the pneumatic jack 1300 comprises a base 1304, a top member 1306, and an air spring 1308. The top member 1306 is pivotally attached to the base 1304 via a pair of distal hollow cylinders 1310 in combination with a distal support rod 1312 that passes through a pair of apertures 1314 in the base 1304. The air spring 1308 rests on the tilting plate 1302, which comprises a base plate 1316, a forward set of wheels 1318 (with their associated bearings), a forward axle 1320, a rearward set of wheels 1322 (with their associated bearings), and a rearward axle 1324. Both sets of wheels 1318, 1322 ride on ramps 1326 (i.e., guides) built into the base 1304. At the same time, the rearward axle 1324, being somewhat oversized, engages slots 1328 defined by the sidewalls of the base 1304.

The tilting plate 1302 is coupled to the top member 1306 via a pair of coupling arms 1330 that span between the tilting plate 1302 and a pair of extensions 1332 defined by the top member 1306. At the proximal end of the coupling arms 1330, the coupling arms 1330 are pivotally joined to the top member 1306 by a lower support rod 1334 that passes through a pair of apertures 1336 in the extensions 1332 and a respective opening 1338 in each of the coupling arms 1330. At the distal end of the coupling arms 1330, the coupling arms 1330 pivotally couple to the tilting plate 1302 via respective hollow cylinders 1340 and pins 1342.

Figure 14:
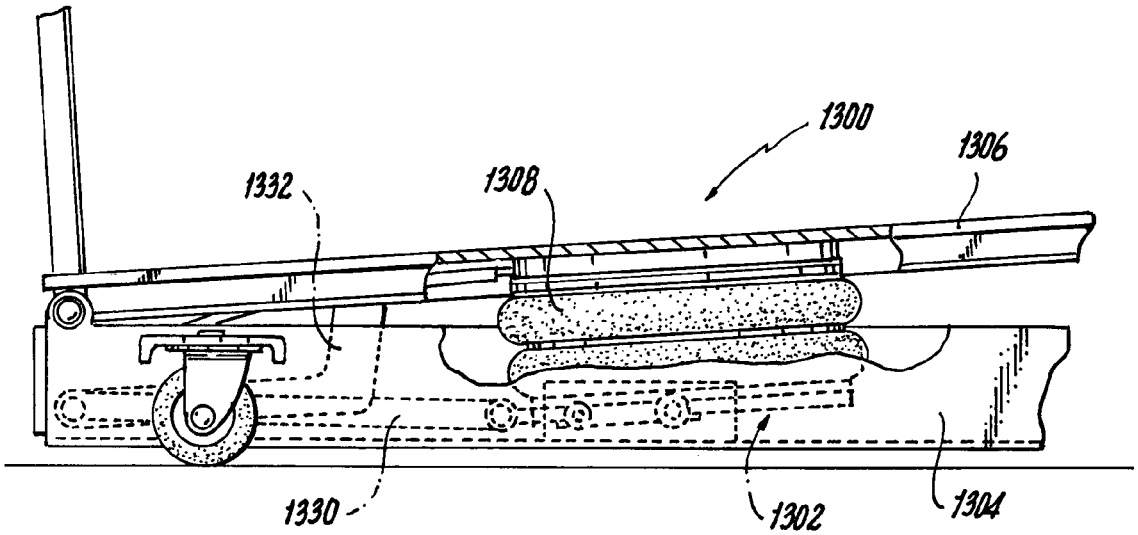
FIG. 14 shows a partially cutaway right elevational view of the FIG. 13 pneumatic jack with the top member only partially raised.
Figure 15:
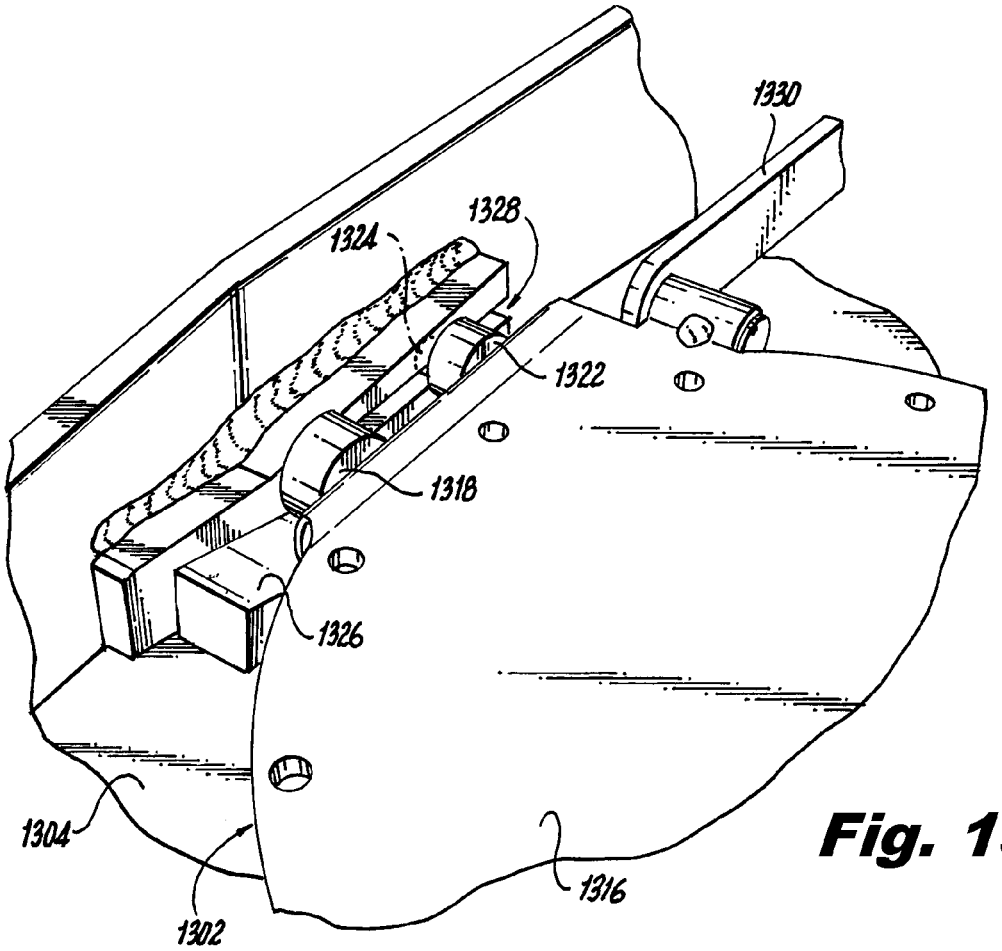
FIG. 15 shows a perspective view of a portion of the tilting plate and the base in the FIG. 13 pneumatic jack with the top member only partially raised.
Figure 16:
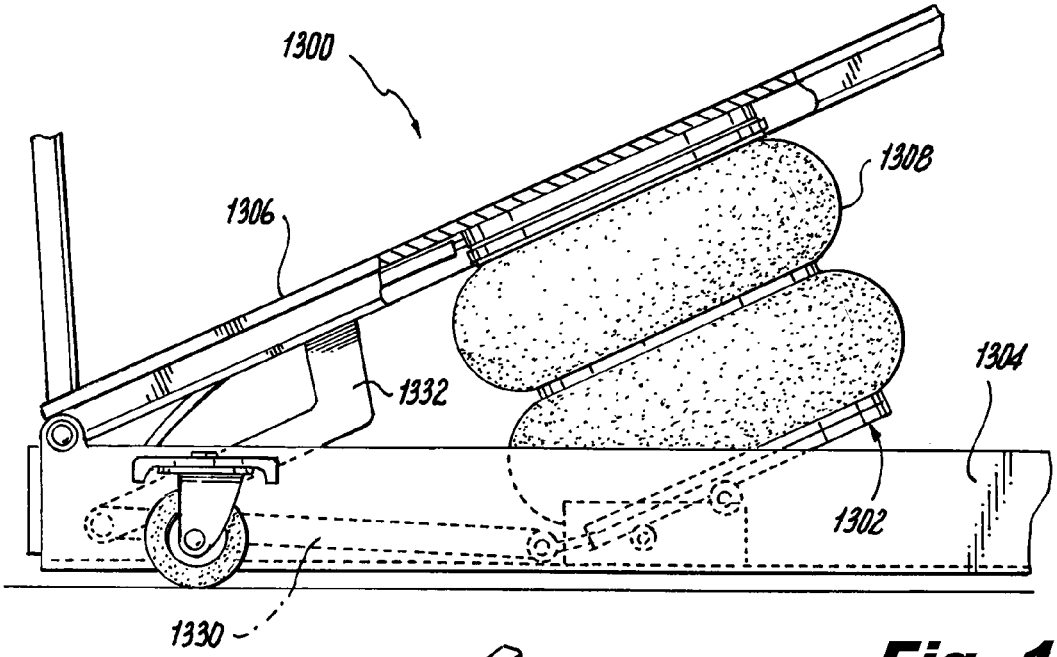
FIG. 16 shows a partially cutaway right elevational view of the FIG. 13 pneumatic jack with the top member fully raised.
Figure 17:
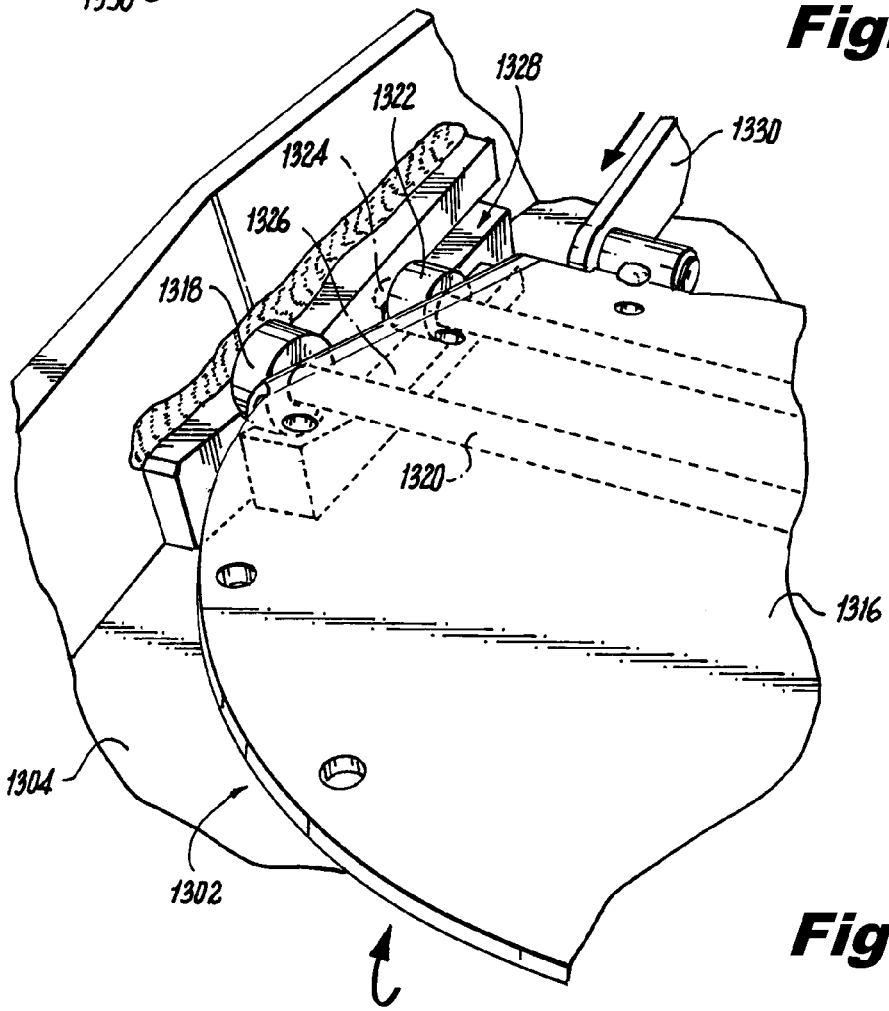
FIG. 17 shows a perspective view of a portion of the tilting plate and the base in the FIG. 13 pneumatic jack with the top member fully raised.

With these various elements arranged in this manner, the coupling arms 1330 urge the tilting plate 1302 along the ramps 1326 when the pneumatic jack 1300 raises and lowers the distal end of the top member 1306 relative to the base 1304. This dynamic is illustrated in FIGS. 14-17, wherein: FIG. 14 shows a partially cutaway right elevational view of the pneumatic jack 1300 with the top member 1306 only partially raised; FIG. 15 shows a magnified perspective view of a portion of the tilting plate 1302 and the base 1304 with the top member 1306 only partially raised; FIG. 15 shows a partially cutaway right elevational view of the pneumatic jack 1300 with the top member 1306 fully raised; and FIG. 16 shows a magnified perspective view of a portion of the tilting plate 1302 and the base 1304 with the top member 1306 fully raised. As can be seen in this sequence of figures, lifting the distal end of the top member 1306 urges the tilting plate 1302 towards the distal end of the pneumatic jack 1300. The ramps 1326, in turn, causes the tilting plate 1302 to tilt so that the base plate 1316 remains substantially parallel to the surface of the top member 1306 above it. The air spring 1308 thereby remains linear during the lift. The subsequent translation of the tilting plate 1302 towards the proximal end of the pneumatic jack 1300 while lowering the top member 1306, likewise also maintains the linearity of the air spring 1308 while lowering the top member 1306.

Figure 18:
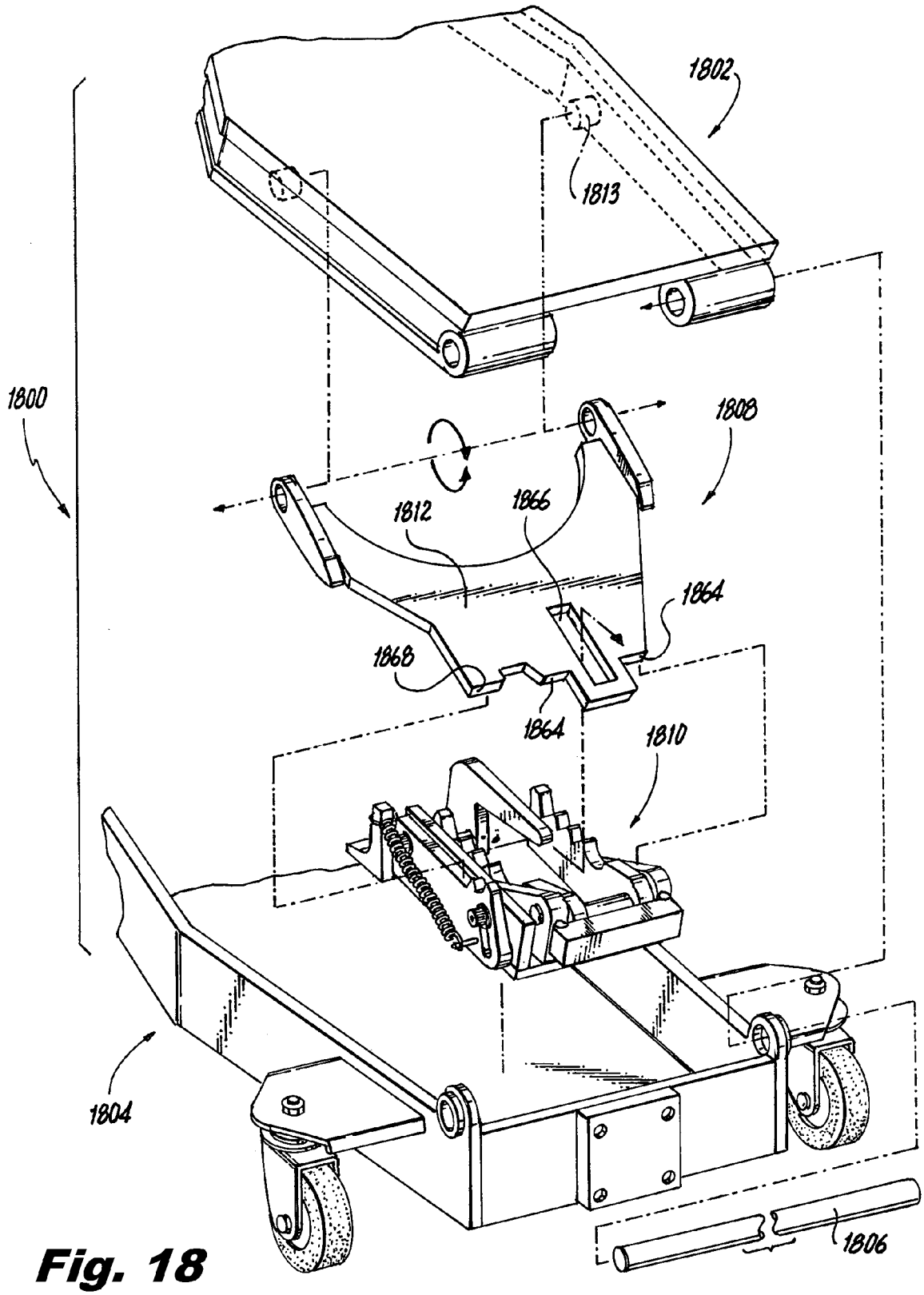
FIG. 18 shows an exploded perspective view of a portion of pneumatic jack in accordance with a fifth illustrative embodiment of the invention.
Figure 19:
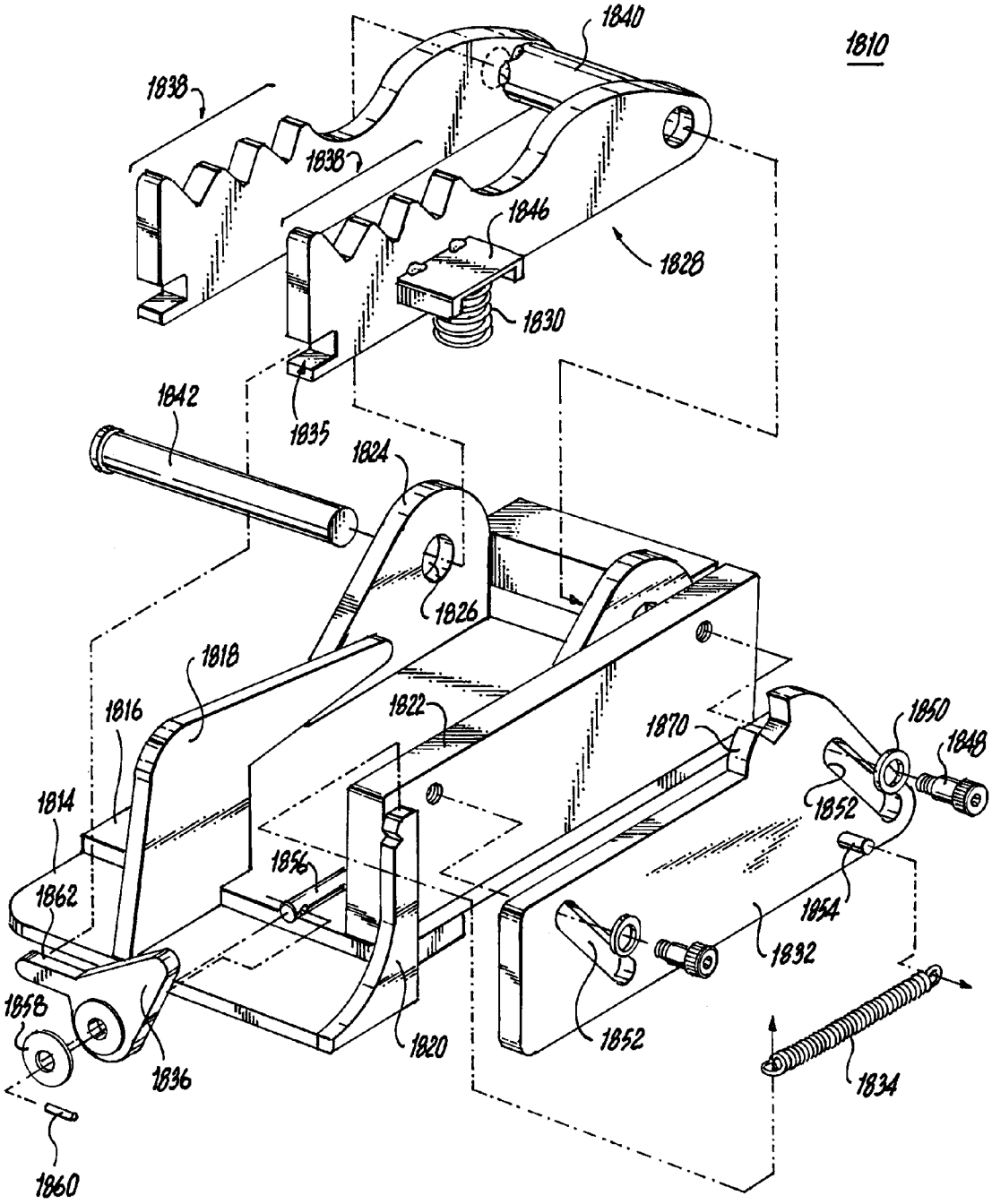
FIG. 19 shows an exploded perspective view of the lower portion of the safety mechanism in the FIG. 18 pneumatic jack.
Figure 20:
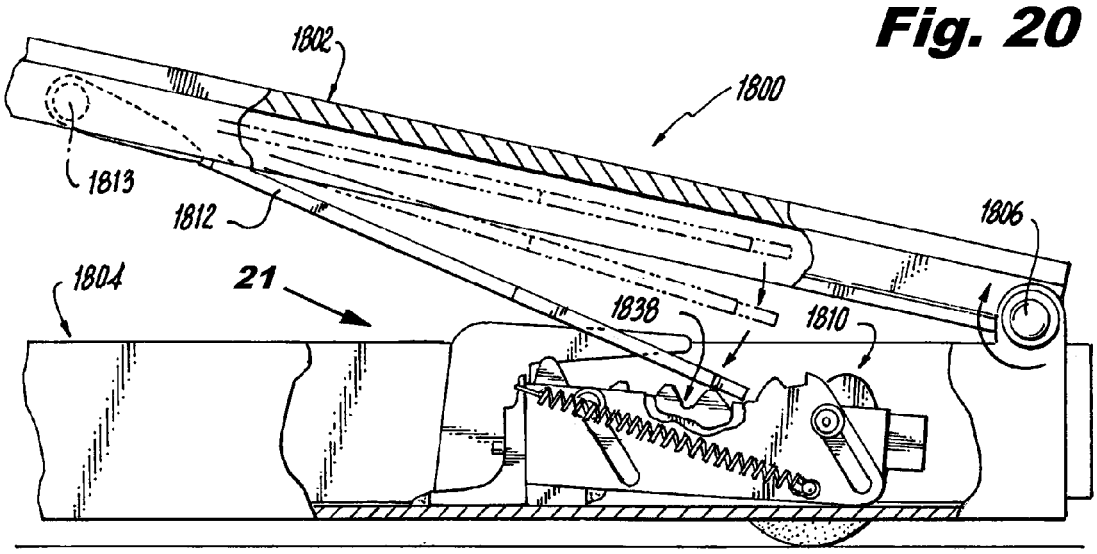
FIG. 20 shows a partially cutaway right elevational view of a portion of the FIG. 18 pneumatic jack while the jack is lifting an object.

In one or more additional embodiments of the invention, an optional safety mechanism may be added to a pneumatic jack having an air spring and a pivoting top member in order to mitigate against the possibility of the top member suddenly dropping if the air spring is compromised (e.g., the air spring loses pneumatic pressure). FIGS. 18-20 show aspects of a pneumatic jack 1800 with such a safety mechanism, in accordance with a fifth illustrative embodiment of the invention. More particularly, FIG. 18 shows an exploded perspective view of a portion of the pneumatic jack 1800, FIG. 19 shows an exploded perspective view of a portion of the safety mechanism in the pneumatic jack 1800, and FIG. 20 shows a partially cutaway left elevational view of a portion of the pneumatic jack 1800 while the pneumatic jack 1800 is lifting an object. As before, these figures are purposefully limited to only those features that are deemed most important to describing aspects of the safety mechanism rather than including all the elements already described in detail above.

Like the pneumatic jack embodiments described earlier, the pneumatic jack 1800 comprises a top member 1802 that is pivotally coupled to a base 1804 utilizing a support rod 1806. The added safety mechanism itself can conceptually be broken into two parts: an upper portion 1808 and a lower portion 1810. The upper portion 1808 consists of a locking plate 1812 that pivotally hangs from two pins 1813 defined by the top member 1802. The lower portion 1810, in contrast, is attached (e.g., welded) to the base 1804 of the pneumatic jack 1800 and comprises a first floor plate 1814 and a second floor plate 1816. The second floor plate 1816 partially overlaps the first floor plate 1814 and, in so doing, is made to angle downward somewhat towards the proximal end of the pneumatic jack (i.e., towards the right in FIG. 20). A guide 1818 and a notched upright 1820 are attached to the first floor plate 1814. A mounting block 1822 and a pair of mounting fixtures 1824 are attached to the second floor plate 1816. Each of the mounting fixtures 1824 defines a respective opening 1826 therein.

As can also be seen in FIGS. 18-20, the lower portion 1810 of the safety mechanism further comprises a receiving member 1828, a first spring 1830, a guide member 1832, a second spring 1834, and a rotatable member 1836. The receiving member 1828 defines two sets of teeth 1838 as well as a hollow cylinder 1840 that is pivotally coupled to the second floor plate 1816 via the openings 1826 in the pair of mounting fixtures 1824 in combination with a support rod 1842. The receiving member 1828 is operative to pivot between a lowered state and a raised state. In the lowered state, the distal end of the receiving member 1828 rests on the second floor plate 1816. In contrast, in the raised state, the distal end of the receiving member 1828 is spaced somewhat above the second floor plate 1816. The pivoting motion of the receiving member 1828 is influenced by the first spring 1830, which underlies an extension 1846 on the receiving member 1828 and biases the receiving member 1828 towards its raised state. At the same time, the guide member 1832 is mounted to the side of the mounting block 1822 utilizing bolts 1848 and washers 1850. Slots 1852 defined in the guide member 1832 allow the guide member 1832 to translate between a lowered position and a raised position. The second spring 1834 spans between a pin 1854 on the guide member 1832 and the top of the notched upright 1820, and biases the guide member 1832 towards its raised position. Finally, the rotatable member 1836 is rotatably mounted to a cylindrical extension 1856 emanating from the second floor plate 1816, and is fixated thereon by a washer 1858 and a retention pin 1860. An arm 1862 on the rotatable member 1836 engages a notch 1835 on the receiving member 1828. This contact between the two elements acts to directly couple the motion of the rotatable member 1836 to the pivoting of the receiving member 1828.

Figure 21:
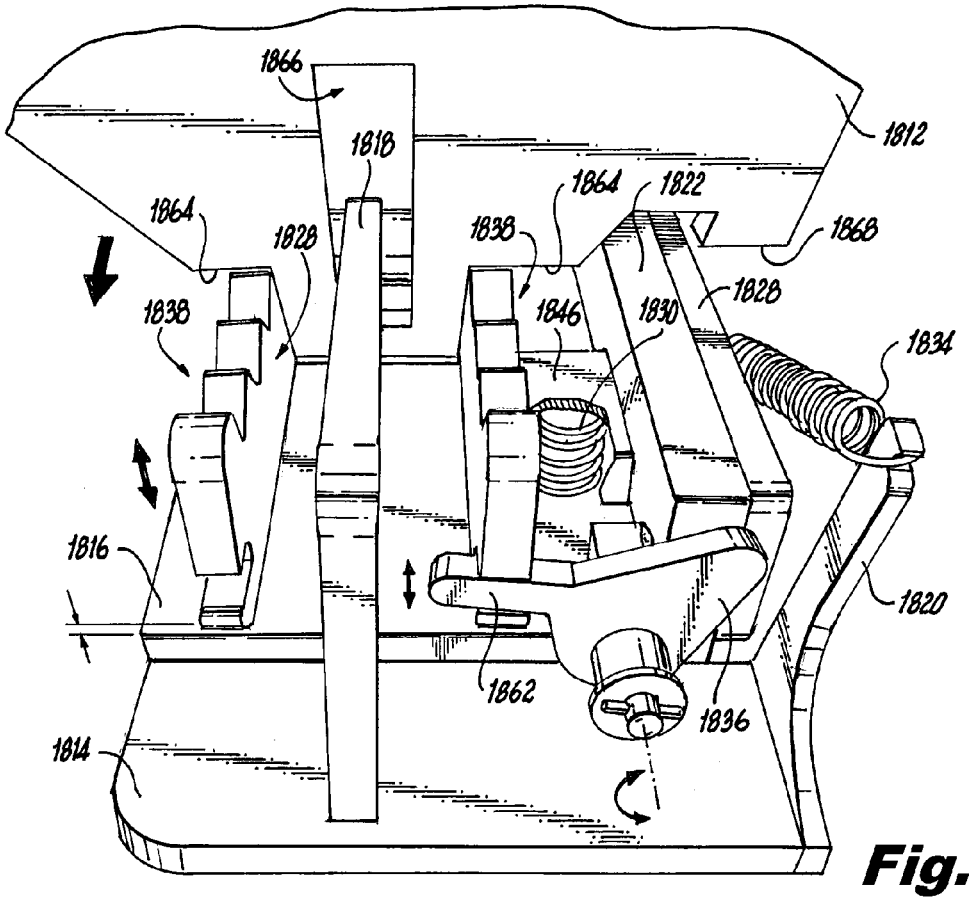
FIG. 21 shows a perspective view of a portion of the safety mechanism in the FIG. 18 pneumatic jack in the armed state.

Advantageously, when these elements are combined as shown in the figures, they cooperate to create a system capable of "catching" the top member 1802 if the air spring suddenly loses pneumatic pressure or is otherwise rendered incapable of continuing to support the top member 1802 while lifting an object. Providing this capability is accomplished by having the safety mechanism take on three states, which are diagrammatically represented by the perspective views in FIGS. 21-23 (with the views directed towards the proximal end of the pneumatic jack 1800). An armed state is shown in FIG. 21 and is initially achieved by lowering the distal end of the top member 1802 as low as it will go towards the base 1804. In the armed state, the guide member 1832 is forced into its lowered position, and the receiving member 1828 takes on its raised state in response to the bias provided by the first spring 1830. Moreover, in response to the raised state of the receiving member 1828, the rotatable member 1836 rotates such that a portion of it mechanically interferes with (i.e., blocks) the translation of the guide member 1832 from its lowered position to its raised position.

Because of the geometry of the locking plate 1812 and the receiving portion, raising the distal end of the top member 1802 with the safety mechanism in its armed state causes the locking plate to tilt downward towards the proximal end of the pneumatic jack 1800, and to thereby cause first lower edge portions 1864 of the top member 1802 to impinge on and be translated in the distal direction over the sets of teeth 1838 (which is precisely the condition shown in FIG. 20). This translation is guided by the guide 1818, which engages a rectangular opening 1866 built into the locking plate 1812. Notably, at this point, the pressure provided by the locking plate 1812 on the receiving member 1828 is limited because of the support provided by the air spring, and the receiving member 1828 retains its raised position in response to the bias provided by the first spring 1830. The safety mechanism is thereby maintained in its armed state as the lift is continued.

Figure 22:
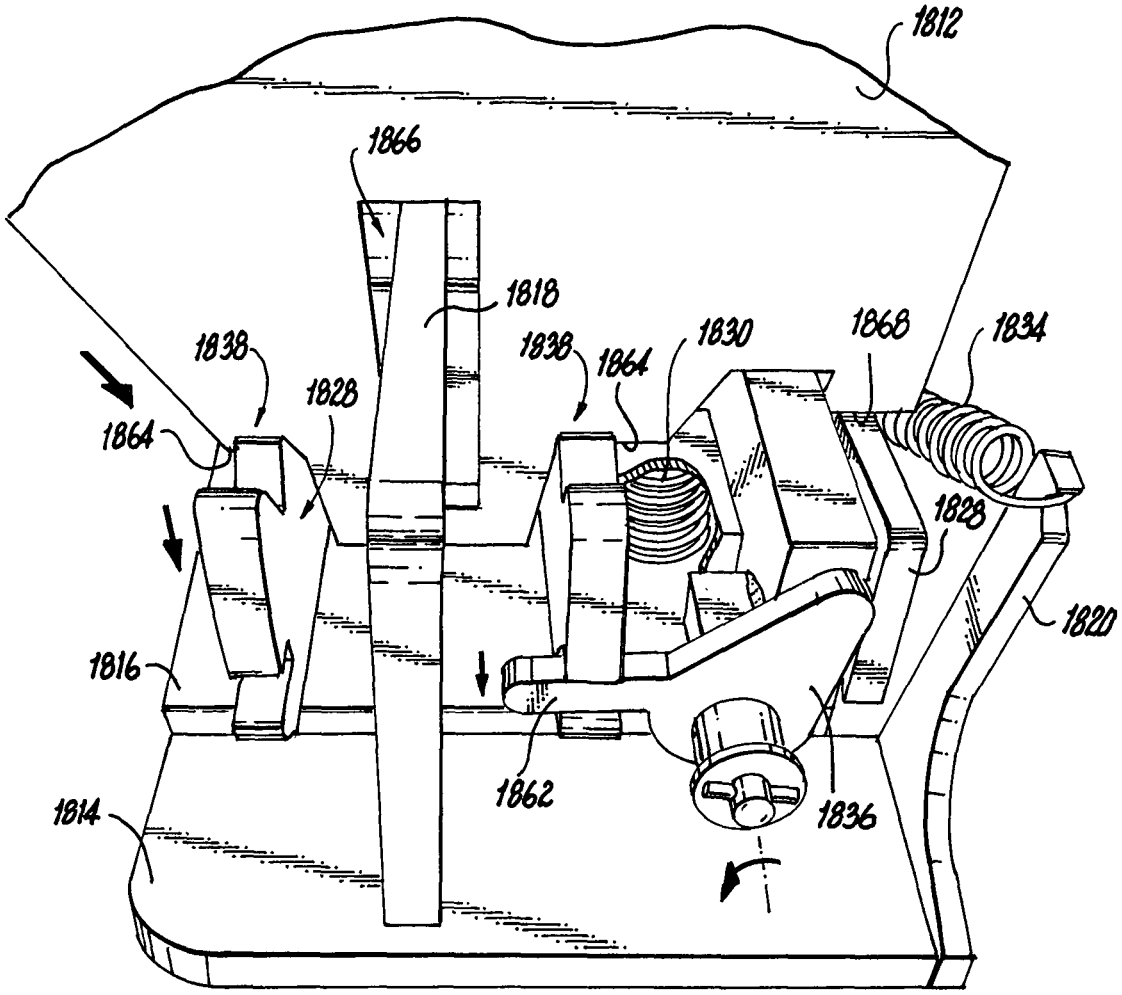
FIG. 22 shows a perspective view of a portion of the safety mechanism in the FIG. 18 pneumatic jack in the engaged state.

Nevertheless, if, after lifting the top member 1802 while the safety mechanism is in its armed state, the air bag is deflated somewhat, either intentionally or due to a failure, the safety mechanism takes on its second state, the engaged state, which is shown in FIG. 22. Release of air from the air spring acts to place substantial weight onto the locking plate 1812 which is, as just described, positioned over the sets of teeth 1838 of the receiving member 1828. This added weight presses on the receiving member 1828, which overcomes the bias of the first spring 1830 and pivots the receiving member 1828 into its lowered state. Simultaneously, the added weight on the locking plate 1812 also acts to solidly lock the first lower edge portions 1864 of the locking plate 1812 against the sets of teeth 1838. So locked, the locking plate 1812 and the receiving member 1828 maintain the top member 1802 in its raised state, thereby acting to "catch" the top member 1802 before it can drop further. At the same time, the pivoting motion of the receiving member 1828 to its lowered state rotates the rotatable member 1836 slightly counter-clockwise (from the perspective shown in FIG. 22) and, thereby places the rotatable member 1836 so that it no longer interferes with the translation of the guide member 1832. Released in this manner, the guide member 1832 translates upward towards its raised position in response to the bias provided by the second spring 1834. Before achieving its fully raised position, however, the guide member 1832 contacts a second lower edge portion 1868 of the locking plate 1812 and, in encountering this interference, cannot travel any further. It therefore remains only partially raised.

Figure 23:
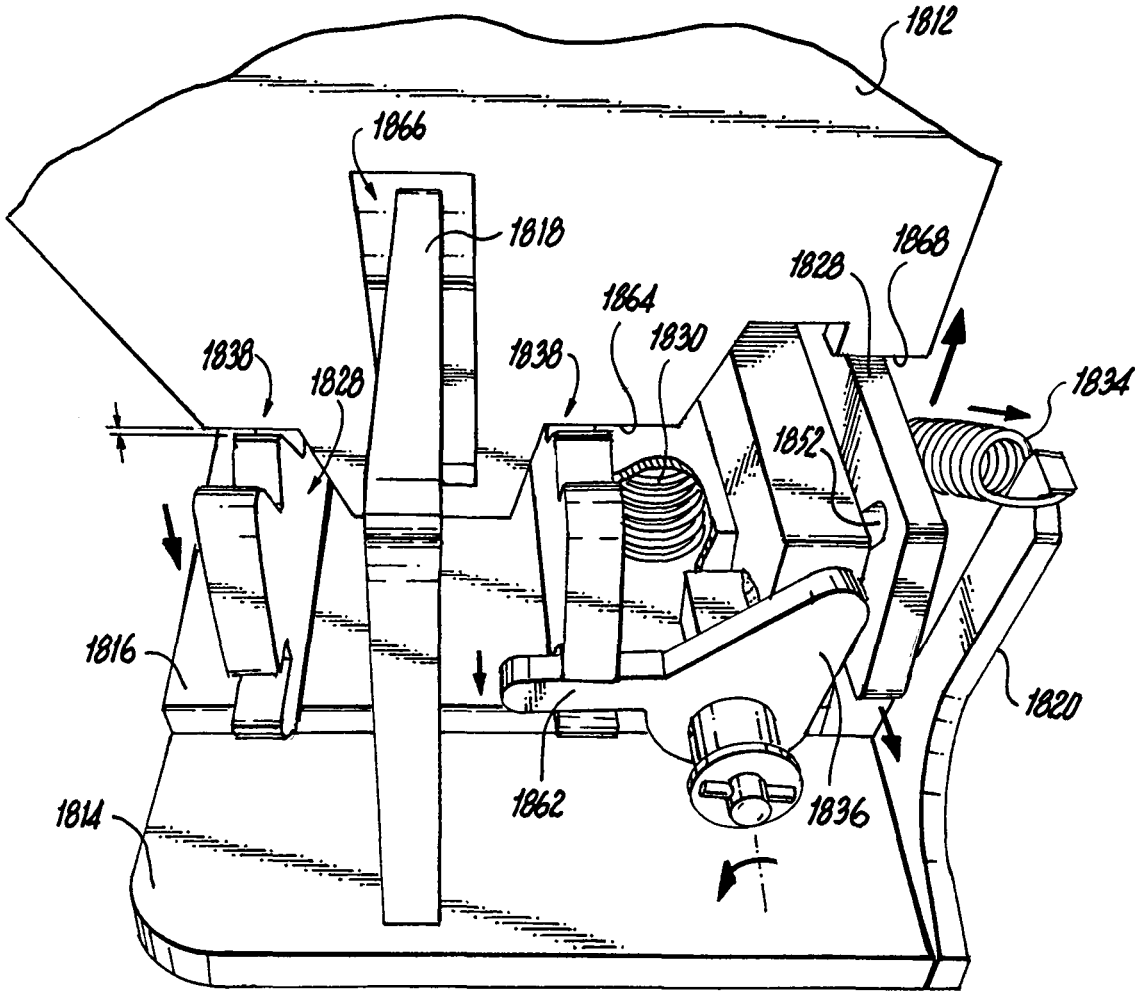
FIG. 23 shows a perspective view of a portion of the safety mechanism in the FIG. 18 pneumatic jack in the disengaged state.

After achieving this engaged state, the top member 1802 of the pneumatic jack 1800 can only be further lowered by causing the safety mechanism to transition from its engaged state into its third state, the disengaged state, which is shown in FIG. 23. Such a transition is achieved by again lifting the top member 1802. If the drop that placed the safety system into the engaged state was caused by the air spring being compromised, this additional lifting can be accomplished by repairing the condition that caused the failure. If, on the other hand, the previous drop of the top member occurred as a result of simply letting air out of the air spring 106, then this additional lifting can be readily accomplished by inflating the air spring slightly. Lifting the top member 1802 has the effect of relieving the pressure on the guide member 1832 and thereby allowing the second spring 1834 to further translate the guide member 1832 towards its raised position. The rising guide member 1832, in turn, pushes upward on the second lower edge portion 1868 of the locking plate 1812, and thereby acts to lift the first lower edge portions 1864 of the locking plate 1812 off of the sets of teeth 1838 of the receiving member 1828. Having now achieved the disengaged state, the first lower edge portions 1864 of the locking plate 1812 are maintained above the sets of teeth 1838 by the guide member 1832. Accordingly, the distal end of the top member 1802 may now be allowed to slowly drop towards the base 1804 without interference from the safety mechanism. While this is occurring, the guide member 1832, now in its raised position, interferes with the clockwise rotation of the rotatable member 1836, maintaining the receiving member 1828 in its lowered state.

Reference to FIGS. 19 and 20 will indicate the presence of an oblique edge 1870 built into the guide member 1832. A purpose of this oblique edge 1870 is to allow the safety mechanism to transition from the disengaged state back into the armed state through the act of dropping the distal end of the top member 1802 as low as it will go towards the base 1804. More particularly, dropping the top member 1802 while the safety mechanism is in the disengaged state after a lift causes the second lower edge portion 1868 of the locking plate 1812 to eventually contact the oblique edge 1870 of the guide member 1832 and to press the guide member 1832 back into its lowered position. Once lowered sufficiently, the guide member 1832 no longer interferes with the rotation of the rotatable member 1836, and the rotatable member 1836 rotates somewhat clockwise while the receiving member 1828 pivots into its raised state in response to the bias provided by the first spring 1830. The safety mechanism is thereby reset back into its armed state (described in detail above), and the pneumatic jack 1800 is ready for another lift.

Because of the complexity of the above-described safety mechanism, it is contemplated that it may be advantageous to provide a visual indicator for a user in order to indicate the state of the mechanism (i.e., armed, engaged, or disengaged). Such a visual indicator may be accomplished in several ways. It may, for example, be implemented by affixing a flexible flag to the guide member 1832 and allowing that flag to protrude through an opening in the base 1804, where it will be visible to the user. Coupled to the guide member 1832 in this manner, the flag will change position as a function of the translation of guide member 1832 from its lowered position to its raised position. This, in turn, allows the flag to directly indicate the state of the safety mechanism (i.e., armed, engaged, or disarmed).

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Moreover, any element in a claim that does not explicitly state "means for" performing a specified function or "step for" performing a specified function is not to be interpreted as a "means for" or "step for" clause as specified in 35 U.S.C. §112, Paragraph 6. In particular, the use of "steps of" in the claims herein is not intended to invoke the provisions of 35 U.S.C. §112, Paragraph 6.

What is claimed is:

1. An apparatus comprising:

a base, the base supported by a plurality of supporting wheels;

a top member, the top member defining a proximal end and a distal end, the proximal end pivotally coupled to the base;

a bladder, the bladder disposed between the base and the top member;

a mounting block, the mounting block pivotally coupled to the distal end of the top member;

a stabilizing member, the stabilizing member pivotally coupled to the base on a proximal side of the bladder and pivotally coupled to the mounting block on a distal side of the bladder such that a portion of the stabilizing member spans over the bladder with the supporting wheels resting on a horizontal surface; and a chain, the chain spanning between the base and the top member, enclosed at least partially within the bladder, and operative to limit an extent to which the apparatus can raise the distal end of the top member away from the base;

wherein the apparatus is operative to raise the distal end of the top member away from the base as the bladder is inflated.

2. The apparatus of claim 1, wherein the mounting block is adapted to support a jack pad.

3. The apparatus of claim 1, wherein the stabilizing member is pivotally coupled to the mounting block at locations different from the top member.

4. The apparatus of claim 1, wherein the top member and the stabilizing member cooperate to maintain the mounting block at a substantially constant orientation relative to the base while the apparatus raises the distal end of the top member away from the base.

5. The apparatus of claim 1, further comprising a valve, the valve operative to control inflation and deflation of the bladder.

6. The apparatus of claim 1, further comprising a handle, the handle coupled to the base at an angle that is manually adjustable.

7. The apparatus of claim 6, wherein the angle is manually adjustable at least in part by raising and lowering a pin into a receiving block defining a plurality of notches thereon.

8. The apparatus of claim 1, wherein the bladder forms a portion of an air spring.

9. The apparatus of claim 1, further comprising:

one or more guides, the one or more guides defined by the base;

a tilting plate, the tilting plate supporting the bladder and translatable along the one or more guides;

one or more coupling arms, the one or more coupling arms coupled to the tilting plate and to the top member, and adapted to urge the tilting plate along the one or more guides when the apparatus raises the distal end of the top member away from the base.

10. The apparatus of claim 9, wherein the tilting plate comprises one or more wheels, and a portion of the one or more guides describes a ramp.

11. The apparatus of claim 1, further comprising:

a receiving member, the receiving member defining a set of teeth; and a locking plate, the locking plate hanging from the top member;

wherein the apparatus is configurable such that the locking plate impinges on the set of teeth of the receiving member while the apparatus raises the distal end of the top member away from the base.

12. The apparatus of claim 11, wherein the apparatus, when configured such that the locking plate impinges on the set of teeth of the receiving member while the apparatus raises the distal end of the top member away from the base, is operative to lock an edge of the locking plate against the set of teeth of the receiving member when the distal end of the top member is subsequently dropped towards the base.

13. A method for lifting an object, the method comprising the steps of:

receiving a base, the base supported by a plurality of supporting wheels;

pivotally coupling a proximal end of a top member to the base;

placing a bladder between the base and the top member;

pivotally coupling a distal end of the top member to a mounting block;

pivotally coupling a stabilizing member to the base on a proximal side of the bladder and pivotally coupling the stabilizing member to the mounting block on a distal side of the bladder such that a portion of the stabilizing member spans over the bladder with the supporting wheels resting on a horizontal surface;

spanning a chain between the base and the top member with the chain enclosed at least partially within the bladder, the chain operative to limit an extent to which the distal end of the top member can be raised away from the base; and raising a distal end of the top member away from the base by inflating the bladder.

14. An apparatus comprising:

a base, the base supported by a plurality of supporting wheels;

a top member, the top member defining a proximal end and a distal end, the proximal end pivotally coupled to the base;

a bladder, the bladder disposed between the base and the top member;

a mounting block, the mounting block pivotally coupled to the distal end of the top member;

a stabilizing member, the stabilizing member pivotally coupled to the base on a proximal side of the bladder and pivotally coupled to the mounting block on a distal side of the bladder such that a portion of the stabilizing member spans over the bladder with the supporting wheels resting on a horizontal surface;

one or more guides, the one or more guides defined by the base;

a tilting plate, the tilting plate supporting the bladder and translatable along the one or more guides; and one or more coupling arms, the one or more coupling arms coupled to the tilting plate and to the top member, and adapted to urge the tilting plate along the one or more guides when the apparatus raises the distal end of the top member away from the base;

wherein the apparatus is operative to raise the distal end of the top member away from the base as the bladder is inflated;

wherein the one or more guides are shaped so as to maintain a surface of the tilting plate substantially parallel to a surface of the top member above the tilting plate as the apparatus raises the distal end of the top member away from the base.

15. An apparatus comprising:

a base, the base supported by a plurality of supporting wheels;

a top member, the top member defining a proximal end and a distal end, the proximal end pivotally coupled to the base;

a bladder, the bladder disposed between the base and the top member;

a mounting block, the mounting block pivotally coupled to the distal end of the top member;

a stabilizing member, the stabilizing member pivotally coupled to the base on a proximal side of the bladder and pivotally coupled to the mounting block on a distal side of the bladder such that a portion of the stabilizing member spans over the bladder with the supporting wheels resting on a horizontal surface;

a receiving member, the receiving member defining a set of teeth and pivotable between a lowered state and a raised state relative to the base;

a locking plate, the locking plate hanging from the top member;

a guide member, the guide member translatable between a lowered position and a raised position relative to the base; and a rotatable member, the rotatable member coupled to the receiving member and operative to rotate in response to the pivoting of the receiving member into a position wherein the rotatable member interferes with the translation of the guide member;

wherein the apparatus is operative to raise the distal end of the top member away from the base as the bladder is inflated;

wherein the apparatus is configurable such that the locking plate impinges on the set of teeth of the receiving member while the apparatus raises the distal end of the top member away from the base.

* * * * *